US010907428B2

(12) United States Patent
Luke et al.

(10) Patent No.: US 10,907,428 B2
(45) Date of Patent: Feb. 2, 2021

(54) LINER DEPLOYMENT ASSEMBLY HAVING FULL TIME DEBRIS BARRIER

(71) Applicant: Weatherford Technology Holdings, LLC, Houston, TX (US)

(72) Inventors: Mike A. Luke, Houston, TX (US); Paul Andrew Reinhardt, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 284 days.

(21) Appl. No.: 15/749,755

(22) PCT Filed: Aug. 2, 2016

(86) PCT No.: PCT/US2016/045120

§ 371 (c)(1),
(2) Date: Feb. 1, 2018

(87) PCT Pub. No.: WO2017/023911

PCT Pub. Date: Feb. 9, 2017

(65) Prior Publication Data

US 2018/0223615 A1 Aug. 9, 2018

Related U.S. Application Data

(60) Provisional application No. 62/200,251, filed on Aug. 3, 2015.

(51) Int. Cl.
*E21B 23/06* (2006.01)
*E21B 33/04* (2006.01)
(Continued)

(52) U.S. Cl.
CPC ..... *E21B 23/06* (2013.01); *E21B 33/04* (2013.01); *E21B 33/043* (2013.01); *E21B 33/05* (2013.01); *E21B 33/16* (2013.01); *E21B 43/101* (2013.01)

(58) Field of Classification Search
CPC ..... E21B 23/06; E21B 33/04; E21B 33/043; E21B 33/05; E21B 33/16; E21B 43/101
See application file for complete search history.

(56) References Cited

U.S. PATENT DOCUMENTS 4,836,288 A 6/1989 Wester
5,582,253 A * 12/1996 Fraser ..... E21B 23/00 166/359

(Continued)

FOREIGN PATENT DOCUMENTS

WO 20140110581 A2 7/2014

OTHER PUBLICATIONS

International Search Report and Written Opinion, PCT/US2016/045120, dated Oct. 17, 2016.

*Primary Examiner* — Matthew R Buck
(74) *Attorney, Agent, or Firm* — Patterson + Sheridan, LLP

(57) ABSTRACT

An assembly for hanging a tubular string includes a packoff (56) having a fastener and a seal for engaging an inner surface of the tubular string and a setting tool. The setting tool includes: a debris cap (84) for engaging an upper end of the tubular string, thereby forming a buffer chamber between the debris cap (84) and the packoff (56); a mandrel (66) having a port formed through a wall thereof; a piston (71): disposed along the mandrel, having an upper face in fluid communication with the port, and operable to stroke the debris cap relative to the mandrel, thereby setting a hanger of the tubular string; an actuator sleeve (71) extending along the mandrel and connected to the piston; a packer actuator (62) including a housing connected to the debris cap above the buffer chamber and a fastener for engaging a profile of the actuator sleeve; and a latch releasably connecting the housing to the mandrel.

20 Claims, 10 Drawing Sheets

(51) Int. Cl.

| | |
|---|---|
| ***E21B 33/043*** | (2006.01) |
| ***E21B 33/05*** | (2006.01) |
| ***E21B 33/16*** | (2006.01) |
| ***E21B 43/10*** | (2006.01) |

(56) References Cited

U.S. PATENT DOCUMENTS

| | | | | |
|---|---|---|---|---|
| 6,065,536 | A * | 5/2000 | Gudmestad | E21B 17/06 166/208 |
| 7,225,870 | B2 * | 6/2007 | Pedersen | E21B 23/01 166/285 |
| 8,807,231 | B2 * | 8/2014 | Reinhardt | E21B 33/04 166/386 |
| 9,650,859 | B2 * | 5/2017 | Zhou | E21B 33/1285 |
| 2011/0108266 | A1 * | 5/2011 | Smith | E21B 23/00 166/208 |
| 2014/0196912 | A1 * | 7/2014 | Turley | E21B 43/10 166/382 |
| 2014/0352944 | A1 | 12/2014 | Devarajan et al. | |
| 2015/0136394 | A1 | 5/2015 | Turley et al. | |

* cited by examiner

LINER DEPLOYMENT ASSEMBLY HAVING FULL TIME DEBRIS BARRIER

BACKGROUND OF THE DISCLOSURE

Field of the Disclosure

The present disclosure generally relates to a liner deployment assembly having a full time debris barrier.

Description of the Related Art

A wellbore is formed to access hydrocarbon bearing formations, e.g. crude oil and/or natural gas, or geothermal formations by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

After the casing string has been cemented into the wellbore, the wellbore may be extended and a liner string installed therein. The liner string is typically deployed into the wellbore using a workstring. A running tool connects the liner string to the workstring. A setting tool is operated to set a hanger of the liner string against the previously installed casing string. The running tool is then operated to release the liner string. The setting tool is then operated to set a packer of the liner string. A junk bonnet closes a top of the liner string to prevent wellbore particles from obstructing operation of the running tool and/or setting tool. However, the junk bonnet is released before setting of the packer, thereby exposing the running tool and setting tool to wellbore particles which could obstruct operation thereof as well as obstructing later tieback operations.

SUMMARY OF THE DISCLOSURE

The present disclosure generally relates to a liner deployment assembly having a full time debris barrier. In one embodiment, an assembly for hanging a tubular string in a wellbore includes a packoff having a fastener and a seal for engaging an inner surface of the tubular string and a setting tool. The setting tool includes: a debris cap for engaging an upper end of the tubular string, thereby forming a buffer chamber between the debris cap and the packoff; a mandrel having a port formed through a wall thereof; a piston: disposed along the mandrel, having an upper face in fluid communication with the port, and operable to stroke the debris cap relative to the mandrel, thereby setting a hanger of the tubular string; an actuator sleeve extending along the mandrel and connected to the piston; a packer actuator comprising a housing connected to the debris cap above the buffer chamber and a fastener for engaging a profile of the actuator sleeve; and a latch releasably connecting the housing to the mandrel.

In another embodiment, a method of hanging a tubular string in a wellbore includes: running the tubular string into the wellbore using a pipe string and a deployment assembly. The deployment assembly has: a debris cap releasably connected to and closing an upper end of the tubular string, a packoff releasably connected to and engaged with the tubular string, and a buffer fluid disposed in a chamber formed between the debris cap and the packoff. The method further includes: pumping a setting plug through the pipe string to the deployment assembly, thereby operating a piston thereof to set a hanger of the tubular string; after setting the hanger, lowering the pipe string, thereby setting a packer of the tubular string; and after setting the packer, raising the pipe string, thereby releasing the debris cap and opening the chamber of the buffer fluid.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
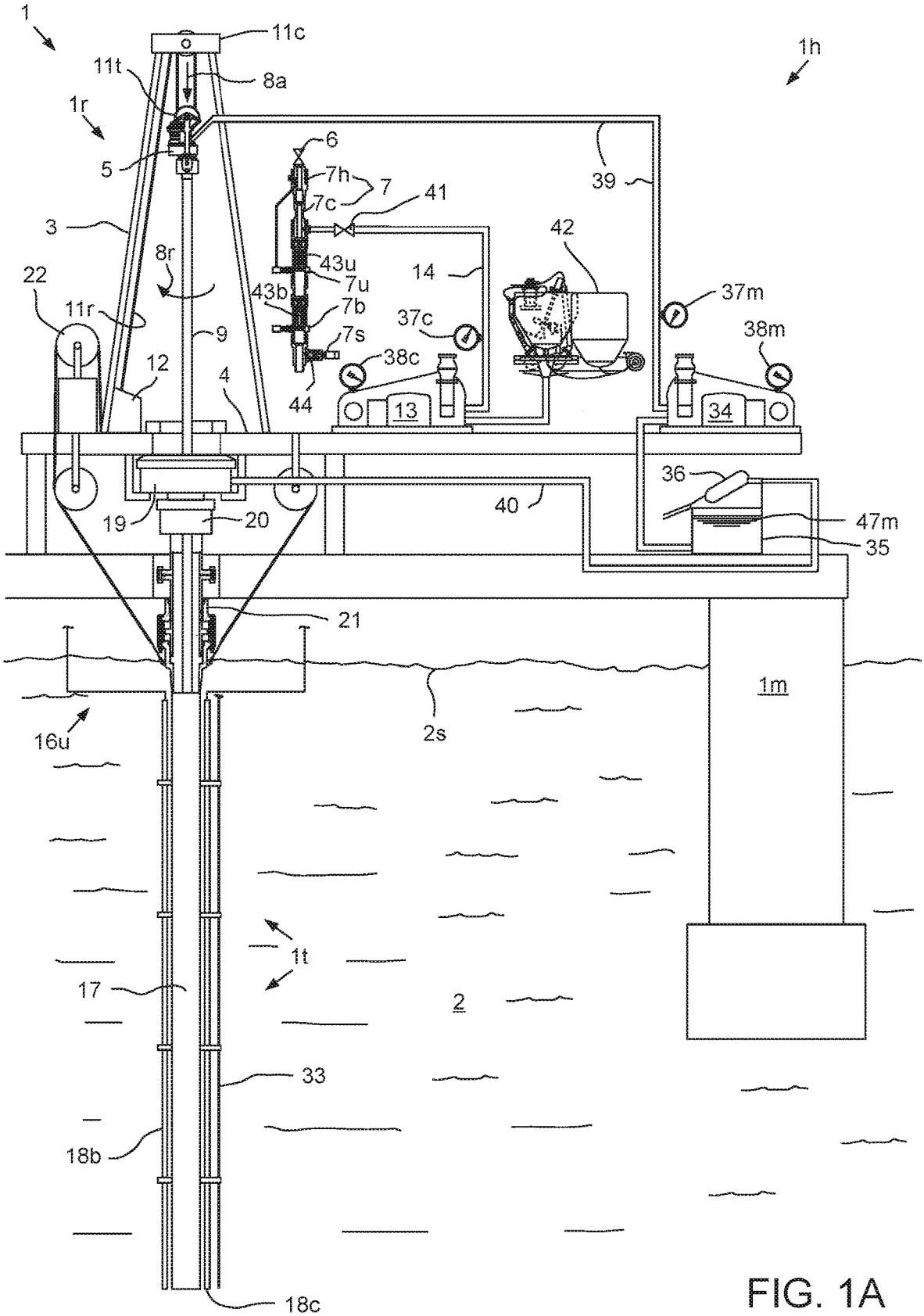
FIGS. 1A, 2A, and 2B illustrate a drilling system in a liner deployment mode, according to one embodiment of this disclosure.
Figure 2A:
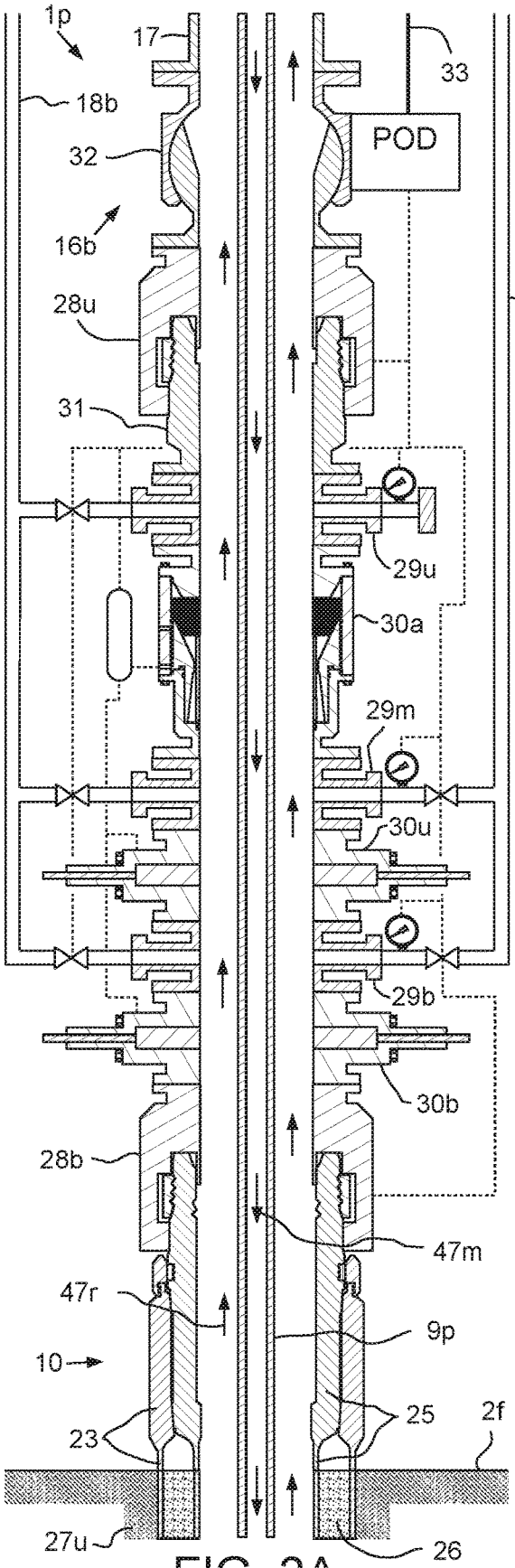
Figure 2B:
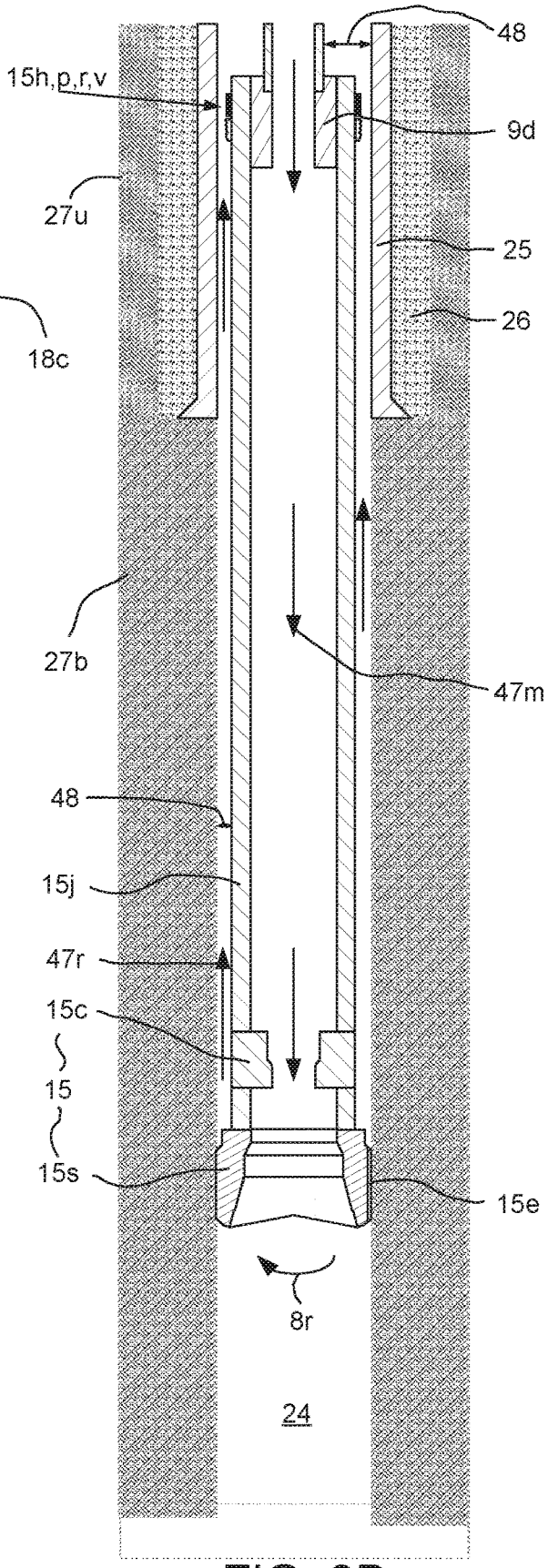
Figures 3A, 3B, 3C, 3D:
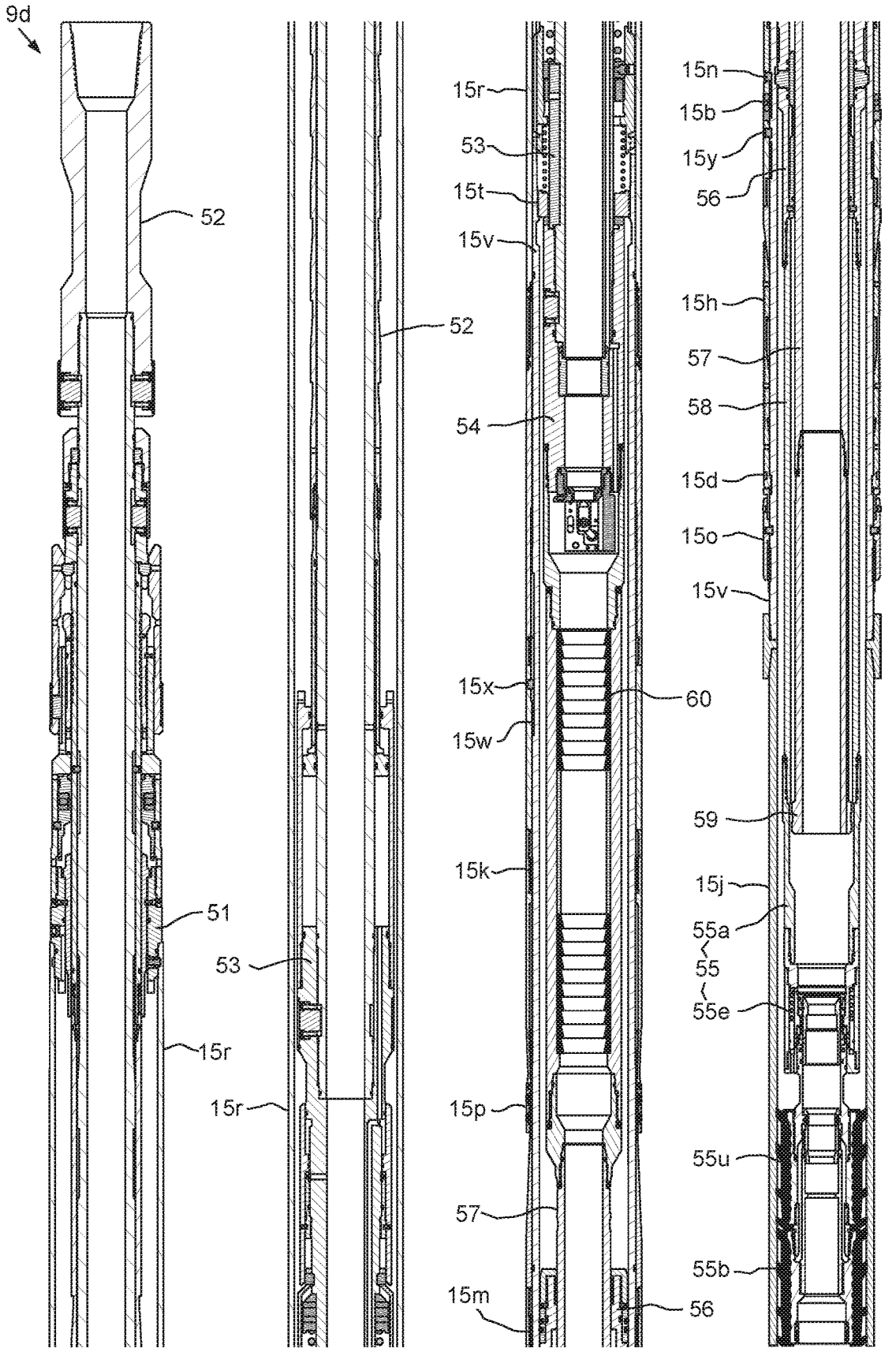
FIGS. 3A-3D illustrate a liner deployment assembly (LDA) of the drilling system.
Figures 4A, 4B, 4C, 4D:
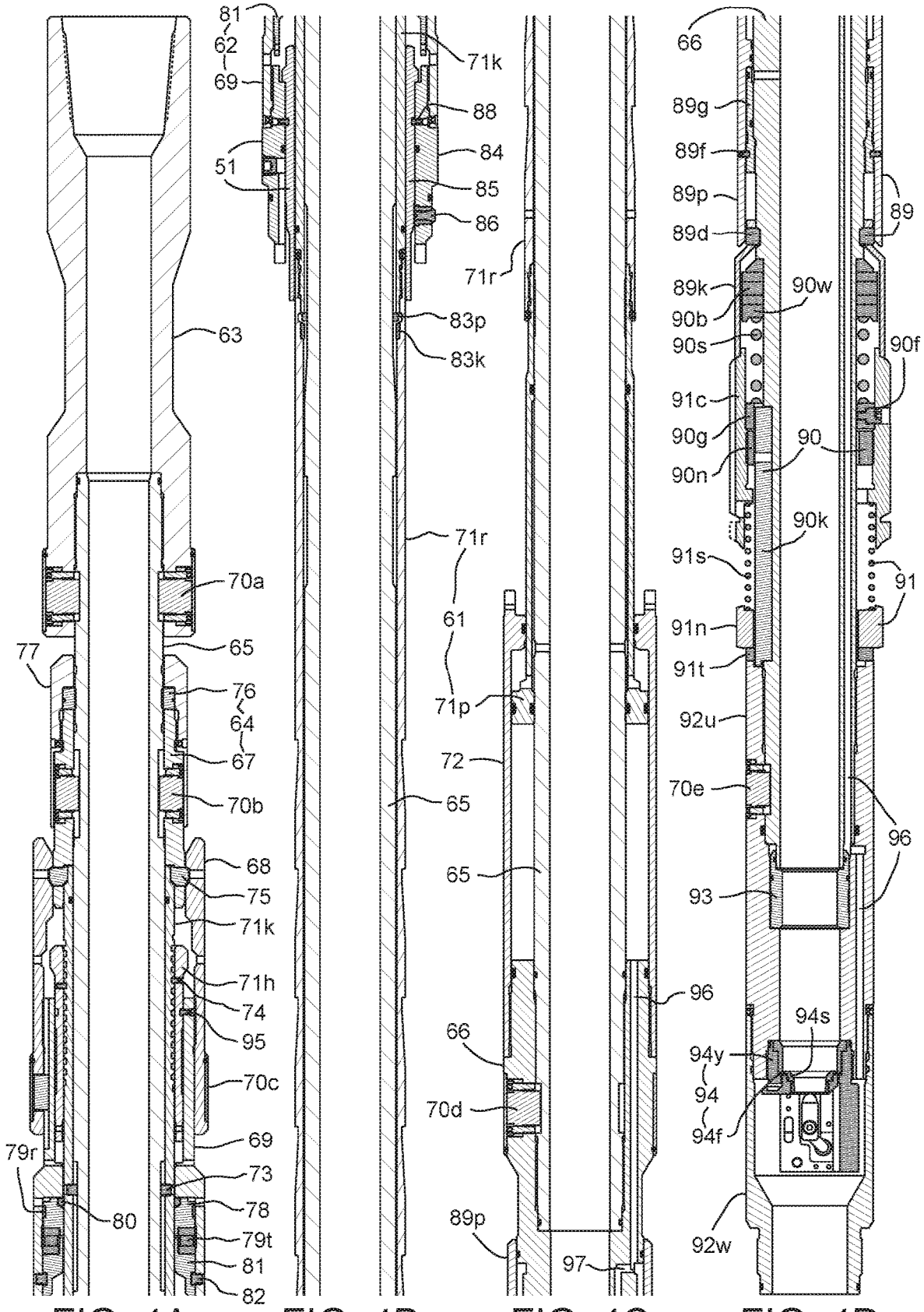
FIGS. 4A-4D illustrate a setting tool, running tool, and catcher of the LDA.

FIGS. 1A-1C illustrate a drilling system 1 in a liner deployment mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system it, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4, a top drive 5, a cementing head 7, and a hoist. The top drive 5 may include a motor for rotating 8*r* the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The frame of the top drive 5 may be suspended from the derrick 3 by the traveling block 11*t*. The quill may be torsionally driven by the top drive motor and supported from the frame by bearings. The top drive may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3. The drilling rig 1*r* may further include a drill string compensator (not shown) to account for heave of the MODU 1*m*. The drill string compensator may be disposed between the traveling block 11*t* and the top drive 5 (aka hook mounted) or between the crown block 11*c* and the derrick 3 (aka top mounted).

In the deployment mode, an upper end of the workstring 9 may be connected to the top drive quill, such as by threaded couplings. The workstring 9 may include a liner deployment assembly (LDA) 9*d* and a pipe string 9*p*, such as joints of drill pipe connected together, such as by threaded couplings. An upper end of the LDA 9*d* may be connected a lower end of the pipe string 9*p*, such as by threaded couplings. The LDA 9*d* may also be connected to a liner string 15. The liner string 15 may include a polished bore receptacle (PBR) 15*r*, a packer 15*p*, a liner hanger 15*h*, a body 15*v* for carrying the hanger and packer (HP body), joints of liner 15*j*, a landing collar 15*c*, and a reamer shoe 15*s*. The HP body 15*v*, liner joints 15*j*, landing collar 15*c*, and reamer shoe 15*s* may be interconnected, such as by threaded couplings. The reamer shoe 15*s* may be rotated 8*r* by the top drive 5 via the workstring 9.

Once liner deployment has concluded, the workstring 9 may be disconnected from the top drive 5 and the cementing head 7 may be inserted and connected therebetween. The cementing head 7 may include an isolation valve 6, an actuator swivel 7*h*, a cementing swivel 7*c*, and one or more plug launchers, such as a top dart launcher 7*u*, a bottom dart launcher 7*b*, and a ball launcher 7*s*. The isolation valve 6 may be connected to a quill of the top drive 5 and an upper end of the actuator swivel 7*h*, such as by threaded couplings. An upper end of the workstring 9 may be connected to a lower end of the cementing head 7, such as by threaded couplings.

The cementing swivel 7*c* may include a housing torsionally connected to the derrick 3, such as by bars, wire rope, or a bracket (not shown). The torsional connection may accommodate longitudinal movement of the swivel 7*c* relative to the derrick 3. The cementing swivel 7*c* may further include a mandrel and bearings for supporting the housing from the mandrel while accommodating rotation 8*r* of the mandrel. An upper end of the mandrel may be connected to a lower end of the actuator swivel, such as by threaded couplings. The cementing swivel 7*c* may further include an inlet formed through a wall of the housing and in fluid communication with a port formed through the mandrel and a seal assembly for isolating the inlet-port communication. The cementing mandrel port may provide fluid communication between a bore of the cementing head and the housing inlet. The seal assembly may include one or more stacks of V-shaped seal rings, such as opposing stacks, disposed between the mandrel and the housing and straddling the inlet-port interface. The actuator swivel 7*h* may be similar to the cementing swivel 7*c* except that the housing may have three inlets in fluid communication with respective passages formed through the mandrel. The mandrel passages may extend to respective outlets of the mandrel for connection to respective hydraulic conduits (only one shown) for operating respective hydraulic actuators of the plug launchers 7*u,b,s*. The actuator swivel inlets may be in fluid communication with a hydraulic power unit (HPU, not shown).

Each dart launcher 7*u,b* may include a body, a canister, a latch, and the actuator and the upper dart launcher may further include a diverter. Each body may be tubular and may have a bore therethrough. To facilitate assembly, each body may include two or more sections connected together, such as by threaded couplings. An upper end of the top dart launcher body may be connected to a lower end of the actuator swivel 7*h*, such as by threaded couplings and a lower end of the bottom dart launcher body may be connected to the workstring 9. Each body may further have a landing shoulder formed in an inner surface thereof. Each canister and the diverter may each be disposed in the respective body bore. The diverter may be connected to the body of the upper launcher 7*u*, such as by threaded couplings. Each canister may be longitudinally movable relative to the respective body. Each canister may be tubular and have ribs formed along and around an outer surface thereof. Bypass passages may be formed between the ribs. Each canister may further have a landing shoulder formed in a lower end thereof corresponding to the respective body landing shoulder. The diverter may be operable to deflect fluid received from a cement line 14 away from a bore of the respective canister and toward the bypass passages. A release plug, such as a top dart 43*u* or a bottom dart 43*b*, may be disposed in the respective canister bore.

Each latch may include a body, a plunger, and a shaft. Each latch body may be connected to a respective lug formed in an outer surface of the respective launcher body, such as by threaded couplings. Each plunger may be longitudinally movable relative to the respective latch body and radially movable relative to the respective launcher body between a capture position and a release position. Each plunger may be moved between the positions by interaction, such as a jackscrew, with the respective shaft. Each shaft may be longitudinally connected to and rotatable relative to the respective latch body. Each actuator may be a hydraulic motor operable to rotate the shaft relative to the latch body.

The ball launcher 7*s* may include a body, a plunger, an actuator, and a setting plug, such as a ball 44, dart, or other obturation member, loaded therein. The ball launcher body may be connected to another lug formed in an outer surface of the dart launcher body, such as by threaded couplings. The ball 44 may be disposed in the plunger for selective release and pumping downhole through the pipe string 9*p* to the LDA 9*d*. The plunger may be movable relative to the launcher body between a captured position and a release position. The plunger may be moved between the positions by the actuator. The actuator may be hydraulic, such as a piston and cylinder assembly.

In operation, when it is desired to launch one of the plugs 43*u,b*, 44 the HPU may be operated to supply hydraulic fluid to the appropriate launcher actuator via the actuator swivel 7*h*. The selected launcher actuator may then move the plunger to the release position (not shown). If one of the dart launchers 7*u,b* is selected, the respective canister and dart 43*u,b* may then move downward relative to the body until the landing shoulders engage. Engagement of the landing shoulders may close the respective canister bypass passages, thereby forcing fluid to flow into the canister bore. The fluid may then propel the respective dart 43*u,b* from the canister bore into a lower bore of the body and onward through the workstring 9. If the ball launcher 7*s* was selected, the plunger may carry the ball 44 into the lower dart launcher body to be propelled into the pipe string 9*p* by the fluid.

The fluid transport system 1*t* may include an upper marine riser package (UMRP) 16*u*, a marine riser 17, a booster line 18*b*, and a choke line 18*c*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 21, such as by a flanged connection. The diverter 21 may also be connected to the rig floor 4, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and a casing string 25 may be deployed into the wellbore. The casing string 25 may include a wellhead housing and joints of casing connected together, such as by threaded couplings. The wellhead housing may land in the conductor housing during deployment of the casing string 25. The casing string 25 may be cemented 26 into the wellbore 24. The casing string 25 may extend to a depth adjacent a bottom of the upper formation 27*u*. The wellbore 24 may then be extended into the lower formation 27*b* using a pilot bit and underreamer (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a rig controller (not shown) onboard the MODU 1*m* via an umbilical 33. The control pod may include one or more control valves (not shown) in communication with the BOPs 30*a,u,b* for operation thereof. Each control valve may include an electric or hydraulic actuator in communication with the umbilical 33. The umbilical 33 may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The rig controller may operate the PCA 1*p* via the umbilical 33 and the control pod.

The fluid handling system 1*h* may include one or more pumps, such as a cement pump 13 and a mud pump 34, a reservoir for drilling fluid 47*m*, such as a tank 35, a solids separator, such as a shale shaker 36, one or more pressure gauges 37*c,m*, one or more stroke counters 38*c,m*, one or more flow lines, such as cement line 14, mud line 39, and return line 40, a cement mixer 42, and one or more tag launchers 44*a,b*. The drilling fluid 47*m* may include a base liquid. The base liquid may be refined or synthetic oil, water, brine, or a water/oil emulsion. The drilling fluid 47*m* may further include solids dissolved or suspended in the base liquid, such as organophilic clay, lignite, and/or asphalt, thereby forming a mud.

A first end of the return line 40 may be connected to the diverter outlet and a second end of the return line may be connected to an inlet of the shaker 36. A lower end of the mud line 39 may be connected to an outlet of the mud pump 34 and an upper end of the mud line may be connected to the top drive inlet. The pressure gauge 37*m* may be assembled as part of the mud line 39. An upper end of the cement line 14 may be connected to the cementing swivel inlet and a lower end of the cement line may be connected to an outlet of the cement pump 13. The shutoff valve 41 and the pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

The workstring 9 may be rotated 8*r* by the top drive 5 and lowered 8*a* by the traveling block 11*t*, thereby reaming the liner string 15 into the lower formation 27*b*. Drilling fluid 47*m* may be pumped into the workstring bore by the mud pump 34 via the mud line 39 and top drive 5. The drilling fluid 47*m* may flow down the workstring bore and the liner string bore and be discharged by the reamer shoe 15*s* into an annulus 48 formed between the workstring 9/liner string 15 and the casing string 25/wellbore 24, where the fluid may circulate cuttings away from the shoe. The returns 47*r* (drilling fluid plus cuttings) may flow up the annulus 48 and exit the wellbore 24 and flow into an annulus formed between the riser 17 and the pipe string 9*p* via an annulus of the LMRP 16*b*, BOP stack, and wellhead 10. The returns 47*r* may exit the riser annulus and enter the return line 40 via an annulus of the UMRP 16*u* and the diverter 19. The returns 47*r* may flow through the return line 40 and into the shale shaker inlet. The returns 47*r* may be processed by the shale shaker 36 to remove the cuttings.

FIGS. 3A-3D illustrate the liner deployment assembly LDA 9*d*. The PBR 15*r*, packer 15*p*, and an upper portion of the liner hanger 15*h* may be longitudinally movable relative to the HP body 15*v* for setting of the packer and liner hanger. A lower end of the packer 15*p* may be linked to an upper end of the liner hanger 15*h* by a thrust bearing 15*b* to longitudinally connect a lower portion of the packer and the hanger upper portion in a downward direction while allowing relative rotation therebetween. The packer lower portion may also be linked to the HP body 15*v* by a pin and slot connection 15*n* to allow relative longitudinal movement therebetween while retaining a torsional connection.

A lower end of the liner hanger 15*h* may be fastened to the HP body 15*v*, such as by an emergency release connection 15*o* to longitudinally and torsionally connect the hanger lower portion to the HP body unless an emergency release maneuver is performed. An upper portion of the packer 15*p* may be linked to the HP body 15*v* by an upper ratchet connection 15*k* and a lower portion of the packer 15*p* may be linked to the HP body by a lower ratchet connection 15*m*. Each ratchet connection 15*k,m* may include a ratchet and a profile of complementing teeth to allow downward movement of the respective packer portion relative to the HP body 15*v* while preventing upward movement of the respective packer portion relative to the HP body.

The hanger upper portion may initially be fastened to the HP body 15*v* by a shearable fastener 15*y* to prevent premature setting of the liner hanger 15*h*. The packer upper portion may also be linked to the HP body 15*v* by a releasable connection 15*x,w* to allow relative longitudinal movement therebetween while retaining a torsional connection. The releasable connection 15*x,w* may maintain the torsional connection until a stroke of the connection is reached. The releasable connection 15*x,w* may include a slot 15*w* formed in an outer surface of the HP body 15*v* and a shearable fastener 15*x* carried by the packer 15*p* and extending into the slot. The releasable connection 15*x,w* may be stroked when the shearable fastener 15*x* engages a bottom of the slot 15*w* and the connection may be released by a threshold force on the packer upper portion to fracture the shearable fastener 15*x*. The slip joint stroke length may correspond to a setting length of the liner hanger 15*h*, such as being slightly greater than. The threshold force may be nominal.

The packer 15*p* may include an adapter, a setting sleeve, a retaining sleeve, a packing element, a wedge, and a ratchet sleeve. An upper end of the adapter may be connected to a lower end of the PBR 15*r*, such as by threaded couplings. An upper end of the setting sleeve may be connected to the lower end of the adapter, such as by threaded couplings. An upper end of the retaining sleeve may be connected to the lower end of the setting sleeve, such as by threaded couplings. The packing element may include a metallic gland, an inner seal, and one or more (two shown) outer seals. The gland may have a groove formed in an outer surface thereof for receiving each outer seal. Each outer seal may include a seal ring, such as an S-ring, and a pair of anti-extrusion elements, such as garter springs. The inner seal may be an o-ring carried in a groove formed in an inner surface of the gland to isolate an interface formed between the gland and the wedge.

The gland inner surface may be tapered having an inclination complementary to an outer surface of the wedge and the gland may be engaged with an upper tip of the wedge. The gland may have cutouts formed in an inner surface thereof to facilitate expansion of the packing element into engagement with the casing 25 (FIG. 9C) and a latch groove formed in the inner surface at an upper end thereof for receiving the retaining sleeve. The retaining sleeve may have an upper base portion and collet fingers extending from the base portion to a lower end thereof. Each collet finger may have a lug formed at a lower end thereof engaged with the retaining sleeve latch groove, thereby fastening the retaining sleeve to the packing element. The collet fingers may be cantilevered from the base portion and have a stiffness urging the lugs toward an engaged position with the latch groove. The HP body 15*v* may carry a seal in an outer surface thereof for sealing an interface formed between the HP body and the wedge. An upper end of the ratchet sleeve may be connected to a lower end of the wedge, such as by threaded couplings.

The liner hanger 15*h* may include a thrust sleeve, a cone, and a plurality of slips. The ratchet sleeve and the thrust sleeve may be linked by the thrust bearing 15*b*. An upper end of the cone may be connected to a lower end of the thrust sleeve, such as by threaded couplings. Each slip may be radially movable between an extended position (FIG. 7C) and a retracted position (shown) by longitudinal movement of the cone relative to the slips. A pocket may be formed in an outer surface of the cone for receiving each slip. Each slip pocket may have an inclined outer surface for extending a respective slip. Each slip may have an inclined inner surface complementary to the slip pocket surface. Each slip may have a groove formed in an outer surface at a lower end thereof. A biasing member, such as a split band 15*d*, may extend through the grooves and have a stiffness urging the slips toward the retracted position. Each slip may have teeth formed along an outer surface thereof and be made from a hard material, such as tool steel, ceramic, or cermet, for engaging and penetrating an inner surface of the casing 25, thereby anchoring the liner string 15 to the casing.

The LDA 9*d* may include a setting tool 52, a running tool 53, a catcher 54, a plug release system 55, a packoff 56, a stinger 57, a spacer 58, a release 59, and a damper 60. An upper end of the setting tool 52 may be connected to a lower end the pipe string 9*p*, such as by threaded couplings. A lower end of the setting tool 52 may be fastened to an upper end of the running tool 53. The running tool 53 may also be fastened to the HP body 15*v*. An upper end of the catcher 54 may be connected to a lower end of the running tool 53. An upper end of the damper 60 may be connected to a lower end of the catcher 54 and a lower end of the damper may be connected to an upper end of the stinger 57, such as by threaded couplings and/or fasteners. A lower end of the stinger 57 may be connected to the release 59, such as by threaded couplings and/or fasteners. The stinger 57 may extend through the packoff 56. The packoff 56 may also be fastened to the HP body 15*v*. An upper end of the spacer 58 may be connected to a lower end of the packoff 56, such as by threaded couplings. An upper end of the plug release system 55 may be connected to a lower end of the spacer 58, such as by threaded couplings.

A debris barrier 51 of the setting tool 52 may be engaged with and close an upper end of the PBR 15*r*, thereby forming an upper end of a buffer chamber. A lower end of the buffer chamber may be formed by a sealed interface between the packoff 56 and the HP body 15*v*. The buffer chamber may be filled with a buffer fluid (not shown), such as fresh water, refined/synthetic oil, or other liquid. The buffer chamber may prevent infiltration of debris from the wellbore 24 from obstructing operation of the LDA 9*d*.

The damper 60 may include a tubular housing and one or more damping sleeves disposed therein and connected thereto. The damping sleeves may be made from an elastomer or elastomeric copolymer for dissipating fluid energy from a shockwave (not shown) emitted by the catcher 54 upon operation thereof. The damper 60 may prevent the shockwave from prematurely operating the plug release system 55.

The packoff 56 may include a cap, a body, an inner seal assembly, such as a seal stack, an outer seal assembly, such as a cartridge, one or more fasteners, such as dogs, and a lock sleeve. The packoff 56 may be tubular and have a bore formed therethrough. The packoff 56 may be fastened to the HP body 15*v* by engagement of the dogs with a groove formed in an inner surface thereof. The cap may be connected to an upper end of the body, such as by threaded couplings and/or fasteners. A lower end of the body may be connected to the upper end of the spacer 58, such as by threaded couplings and/or fasteners. The seal stack may be disposed in a groove formed in an inner surface of the body. The seal stack may be connected to the body by entrapment between a shoulder of the groove and a lower face of the cap. The seal stack may include an upper adapter, an upper set of one or more directional seals, a center adapter, a lower set of one or more directional seals, and a lower adapter. The cartridge may be disposed in a groove formed in an outer surface of the body. The cartridge may be connected to the body by entrapment between a shoulder of the groove and a lower end of the cap. The cartridge may include a gland and one or more (two shown) seal assemblies. The gland may have a groove formed in an outer surface thereof for receiving each seal assembly. Each seal assembly may include a seal, such as an S-ring, and a pair of anti-extrusion elements, such as garter springs. The body may also carry a seal to isolate an interface formed between the body and the gland. The body may have a stop shoulder formed in an inner surface thereof.

Figure 9A:
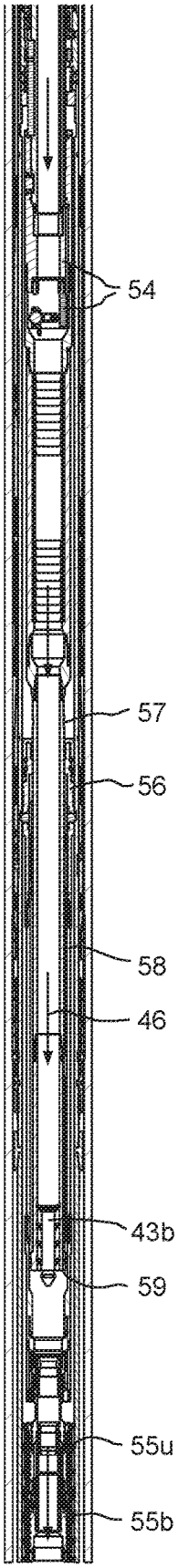
Figure 9B:
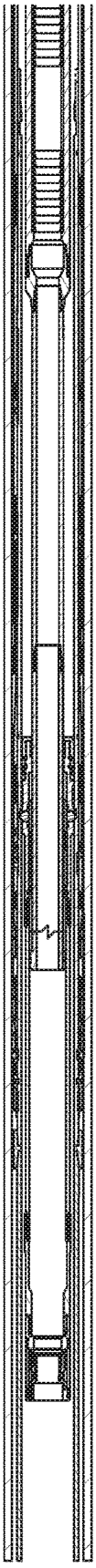
Figure 9C:
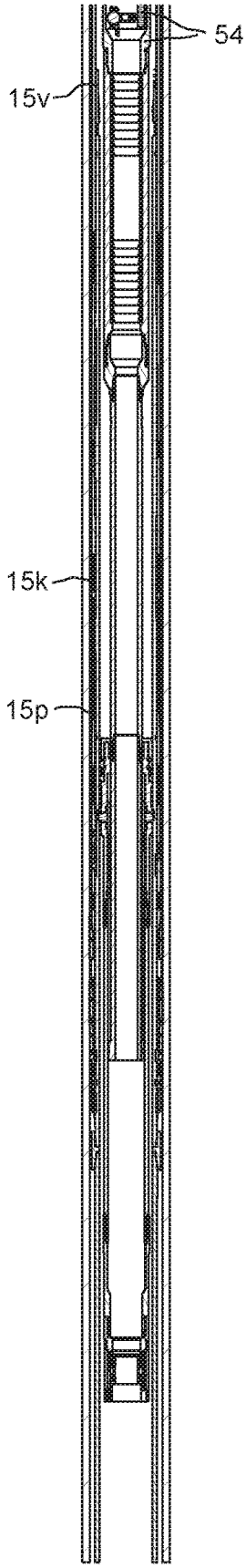
Figure 9D:
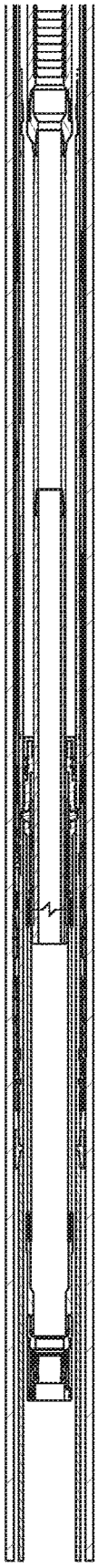
Figure 9E:
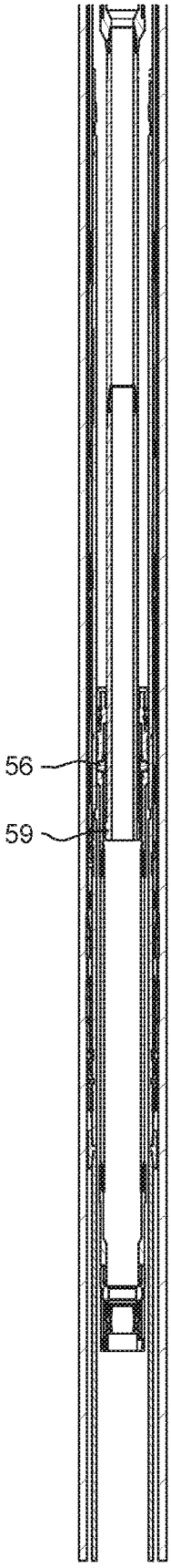

The lock sleeve of the packoff 56 may be disposed in a bore of the body and longitudinally movable relative thereto between a lower locked position (shown) and an upper release position (FIG. 9E). The lock sleeve may be stopped in the release position by engagement of an upper end thereof with the stop shoulder of the body and releasably connected to the body in the lower position by one or more shearable fasteners. The body may have one or more openings formed therethrough and spaced therearound to receive a respective dog therein. Each dog may extend into the groove of the HP body 15*v*, thereby fastening a lower portion of the LDA 9*d* to the liner string 15. Each dog may be radially movable relative to the body between an extended position (shown) and a retracted position (FIG. 9E). Each dog may be extended by interaction with a cam profile formed in an outer surface of the lock sleeve. The lock sleeve may further have a groove formed in an outer surface thereof for alignment with the dogs in the release position, thereby allowing the dogs to retract thereto. The lock sleeve may be moved to the release position by engagement of the release 59 with a bottom thereof.

The plug release system 55 may include an adapter 55*a*, an equalization valve 55*e*, and one or more cementing plugs, such as a top wiper plug 55*u* and a bottom wiper plug 55*b*. The adapter 55*a* may connect the spacer 58 to the equalization valve 55*e*, such as by threaded couplings and/or fasteners.

The equalization valve 55*e* may include a housing, an outer wall, a cap, a piston, a spring, a collet, and a seal insert. The housing, outer wall, and cap may be interconnected, such as by threaded couplings. The piston and spring may be disposed in an annular chamber formed radially between the housing and the outer wall and longitudinally between a shoulder of the housing and a shoulder of the cap. The piston may divide the chamber into an upper portion and a lower portion and carry a seal for isolating the portions. The cap and housing may also carry seals for isolating the portions. The spring may bias the piston toward the cap. The cap may have a port formed therethrough for providing fluid communication between the annulus 48 and the chamber lower portion and the housing may have a port formed through a wall thereof for venting the upper chamber portion. An outlet port may be formed by a gap between a bottom of the housing and a top of the cap. As pressure from the annulus 48 acts against a lower surface of the piston through the cap passage, the piston may move upward and open the outlet port to facilitate equalization of pressure between the annulus and a bore of the housing to prevent surge pressure from prematurely releasing the wiper plugs 55*u,b*.

The top wiper plug 55*u* may be made from one or more drillable materials and include a finned seal, a mandrel, a latch sleeve, a lock sleeve. The latch sleeve may have a collet formed in an upper end thereof. The lock sleeve may have a seat and seal bore formed therein. The lock sleeve may be movable between an upper position and a lower position and be releasably restrained in the upper position by a shearable fastener. The shearable fastener may releasably connect the lock sleeve to the valve housing and the lock sleeve may be engaged with the valve collet in the upper position, thereby locking the valve collet into engagement with the collet of the latch sleeve. To facilitate subsequent drill-out, the plug mandrel may further have a portion of an auto-orienting torsional profile formed at a lower end thereof.

The bottom wiper plug 55*b* may be made from one or more drillable materials and include a finned seal, a mandrel, a latch sleeve, and a lock sleeve. The latch sleeve may have a collet formed in an upper end thereof. The lock sleeve may have a seat and seal bore formed therein. The lock sleeve may be movable between an upper position and a lower position and be releasably restrained in the upper position by a shearable fastener. The shearable fastener may releasably connect the lock sleeve to the mandrel of the top wiper plug 55*u* and the lock sleeve may be engaged with the collet thereof in the upper position, thereby locking the collet into engagement with the collet of the latch sleeve. To facilitate subsequent drill-out, the plug mandrel may further have a portion of an auto-orienting torsional profile formed at each end thereof. The bottom wiper plug 55*b* may further have a bypass port formed through the mandrel and a burst tube sealing the bypass port.

The float collar 15*c* may include a housing, a check valve (not shown), and a body (not shown). The body and check valve may be made from drillable materials. The body may have a bore formed therethrough and the torsional profile portion formed in an upper end thereof for receiving the bottom wiper plug 55*b*. The check valve may include a seat, a poppet disposed within the seat, a seal disposed around the poppet and adapted to contact an inner surface of the seat to close the body bore, and a rib. The poppet may have a head portion and a stem portion. The rib may support a stem portion of the poppet. A spring may be disposed around the stem portion and may bias the poppet against the seat to facilitate sealing. During deployment of the inner liner string 15, the drilling fluid 47*m* may be pumped down at a sufficient pressure to overcome the bias of the spring, actuating the poppet downward to allow drilling fluid to flow through the bore of the body and into the annulus 48.

FIGS. 4A-4D illustrate the setting tool 52, running tool 53, and catcher 54. The setting tool 52 may include the debris barrier 51, a hanger actuator 61, a packer actuator 62, an adapter 63, a latch 64, and a mandrel 65. Each of the adapter 63 and mandrel 65 may be tubular and may have a bore formed therethrough. The adapter 63 may have a coupling, such as a threaded box, formed at an upper end thereof for connection to a lower end of the pipe string 9*p*. An upper end of the setting mandrel 65 may be connected to a lower end of the adapter 63, such as by threaded couplings and a keyed connection 70*a*. An inner sleeve 67 of the latch 64 may be connected to the setting mandrel 65 adjacent to the upper end thereof, such as by a threaded nut 76 and a keyed connection 70*b*. An outer sleeve 68 of the latch 64 may be connected to a housing 69 of the packer actuator 62, such as by threaded couplings and a keyed connection 70*c*. A mandrel 66 of the running tool 53 may be connected to a lower end of the setting mandrel 65, such as by threaded couplings and a keyed connection 70*d*. An upper housing 92*u* of the catcher 54 may be connected to the running mandrel 66, such as by threaded couplings and a keyed connection 70*e*.

Each keyed connection 70*a-e* may include one or more outer keyways formed through a wall of an outer member and corresponding inner keyways formed in an outer surface of the inner member. Each outer member may have flanges formed in the wall thereof adjacent to the respective keyways for receiving respective keys. Each flange may have one or more (two shown) threaded sockets formed therein. Each key may have a flange portion and a shank portion. The key flange portion may engage the respective flange of the outer member and have sockets corresponding to the threaded sockets thereof. A threaded fastener may be inserted through each flange portion and screwed into the respective threaded socket of the outer member, thereby fastening the key thereto. Each key shank portion may extend through the respective keyway of the outer member and into the respective keyway of the inner member, thereby longitudinally and torsionally connecting the outer and inner members. With the exception of the keyed connection 70*b*, the outer member may also have a shoulder and seal surface formed adjacent to the flange for receiving a cover sleeve and a cover seal.

A seal receptacle may be formed in an inner surface of the adapter 63 at a lower portion thereof and a top of the setting mandrel 65 may carry a seal on an outer surface thereof and be stabbed into the seal receptacle, thereby sealing an interface between the adapter and the setting mandrel. A seal receptacle may be formed in an inner surface of the running mandrel 66 at a top thereof and a lower portion of the setting mandrel 65 may carry a seal on an outer surface thereof and be stabbed into the seal receptacle, thereby sealing an interface between the hanger actuator 61 and the setting mandrel. A seal receptacle may be formed in an inner surface of the running mandrel 66 at an upper portion thereof and a bottom of the setting mandrel 65 may carry a seal on an outer surface thereof and be stabbed into the seal receptacle, thereby sealing an interface between the setting tool 52 and the running tool 53.

The hanger actuator 61 may include a lock sleeve 71*k*, a push sleeve 71*h*, a ratchet sleeve 71*r*, a piston 71*p*, a cylinder 72, a keeper 83*k*, and a fastener, such as a snap ring 83*p*. The lock sleeve 71*k*, ratchet sleeve 71*r*, and piston 71*p* may interconnected, such as by threaded couplings and/or fasteners. The lock sleeve 71*k*, ratchet sleeve 71*r*, and piston 71*p* may be disposed around and extend along an outer surface of the setting mandrel 65. The lock sleeve 71*k* may carry one or more (pair shown) shearable pins 73 extending into respective slots formed in an outer surface of and along the setting mandrel 65. The pin 73 and slot connection may link the lock sleeve 71*k*, ratchet sleeve 71*r*, and piston 71*p* to the setting mandrel 65 to allow relative longitudinal movement therebetween while retaining a torsional connection. The ratchet sleeve 71*r* may have one or more (pair shown) equalization ports formed through a wall thereof. The lock sleeve 71*k* may carry a seal in an inner surface thereof, located adjacent a top thereof, and engaged with an outer surface of the setting mandrel 65, thereby sealing an interface therebetween.

The push sleeve 71*h* may be disposed around and extend along an outer surface of the lock sleeve 71*k*. The push sleeve 71*h* carry one or more (pair shown) shearable fasteners 74 extending into a helical groove formed in and along an outer surface of the lock sleeve 71*k*, thereby releasably connecting the push sleeve and the lock sleeve. The shearable fasteners 74 may be configured to fracture at a threshold force corresponding to a setting force of the liner hanger 15*h*, such as slightly greater than the hanger setting force. The threshold force may also be substantially less than a setting force of the packer 15*p*. The setting force of the packer 15*p* may be substantially greater than the setting force of the liner hanger 15*h*, such as greater than or equal to twice the hanger setting force.

A bottom of the cylinder 72 may be connected to a top of the running mandrel 66, such as by threaded couplings. The top of the running mandrel 66 may carry an outer seal for sealing against an inner surface of the cylinder 72. An actuation chamber may be formed radially between the setting mandrel 65 the cylinder 72 and longitudinally between a shoulder formed in an inner surface of the cylinder and a top of the running mandrel 66. A foot of the piston 71*p* may be disposed in the actuation chamber and may divide the chamber into an upper portion and a lower portion.

The actuation chamber upper portion may be in fluid communication with the mandrel bore via one or more (pair shown) actuation ports formed through a wall of the setting mandrel 65 and one or more (pair shown) actuation ports formed a heel of the piston 71*p*. The piston foot may carry inner and outer seals for sealing respective sliding interfaces between the piston foot and the setting mandrel 65 and between the piston foot and the cylinder 72. The cylinder 72 may carry a seal in an inner surface of the shoulder thereof for sealing a sliding interface between a leg of the piston 71*p* and the cylinder. The piston leg may carry a seal in an inner surface thereof for sealing a sliding interface between the piston leg and the setting mandrel 65.

The piston 71*p* and the actuator sleeves 71*k,r* may be longitudinally movable relative to the cylinder 72 between an upper position (shown) and a lower position (FIG. 6D) in response to a pressure differential between an upper face of the foot and a lower face of the foot. The chamber lower portion may be in fluid communication with a lower portion of a bore of the LDA 9*d* via a bypass passage 96 formed, such as by gun-drilling, in and along a wall of the running mandrel 66 and in and along a wall of the catcher upper housing 92*u*.

Figures 8A, 8B, 8C, 8D, 8E:
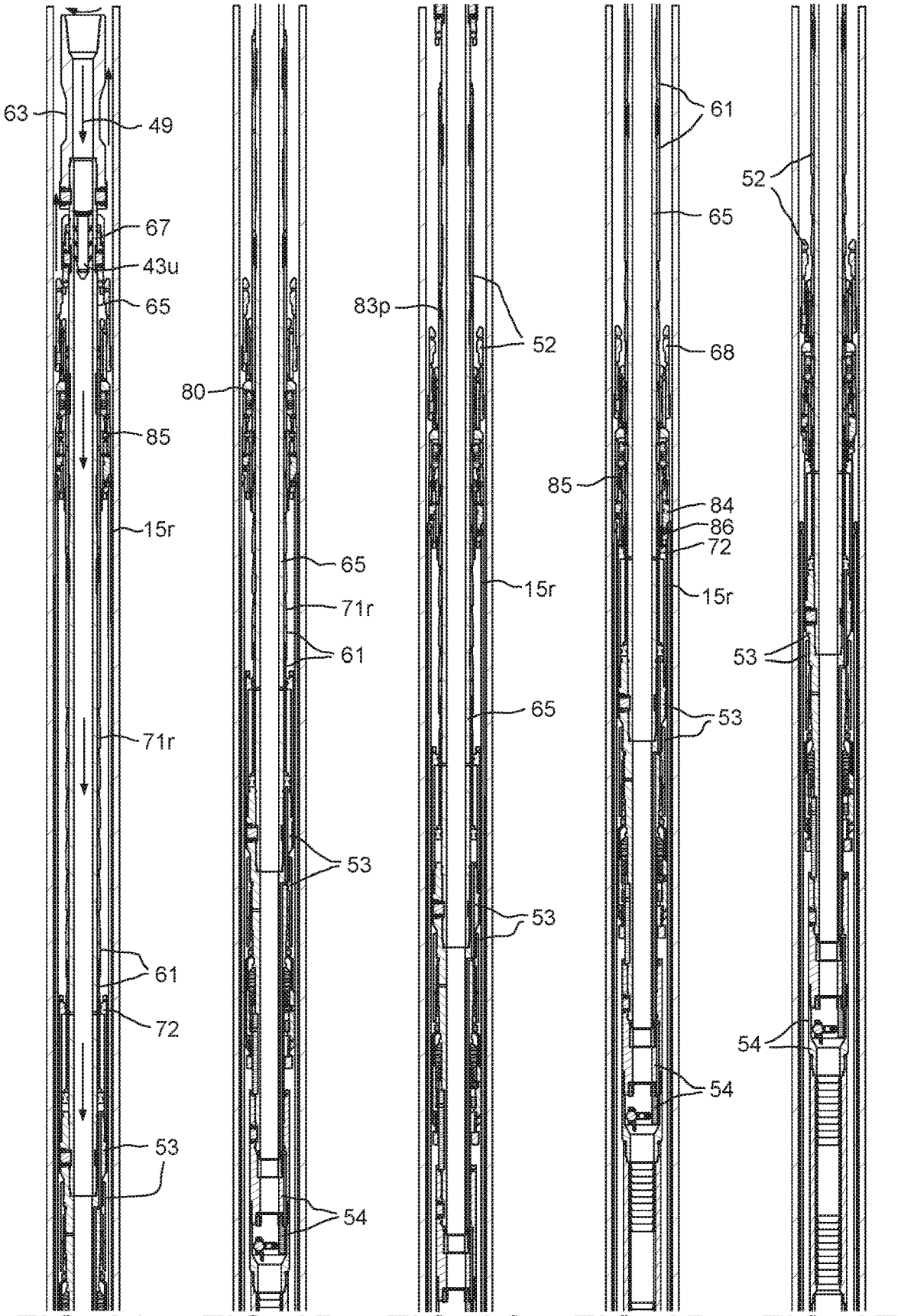

The keeper 83*k* may be disposed in a cutout formed in an inner surface of the ratchet sleeve 71*r* and connected thereto, such as by press fit or bonding. The snap ring 83*p* may be trapped between the keeper 83*k* and a bottom of the lock sleeve 71*k* and may be radially movable between an expanded position (FIG. 6C) and a contracted position (FIG. 8B). The ratchet sleeve 71*r* may have a groove formed in an inner surface thereof adjacent to the cutout for accommodating expansion of the snap ring 83*p*. The snap ring 83*p* may be naturally biased toward the contracted position and may be moved between the positions by engagement with a latch profile formed in an outer surface of the setting mandrel 65. The latch profile of the setting mandrel 65 may have a ramp portion and a groove portion and the groove portion may have an upper straight shoulder and a substantial length, thereby longitudinally linking the hanger actuator 61 and the setting mandrel upon engagement of the snap ring 83*p* with the latch profile.

The latch 64 may releasably connect the packer actuator 62 to the setting mandrel 65. The latch 64 may include the inner sleeve 67, the outer sleeve 68, one or more (pair shown) fasteners, such as dogs 75, the threaded nut 76, a cap 77, and the lock sleeve 71*k*. The cap 77 may be connected to the inner sleeve 67, such as by threaded couplings and/or fasteners. The threaded nut 76 may be disposed between a shoulder of the cap 77 and a top of the inner sleeve 67, thereby connecting the members together. The threaded nut 76 may carry a seal in an outer surface thereof engaged with an inner surface of the cap 77, thereby sealing an interface therebetween.

Figures 6A, 6B, 6C, 6D, 6E:
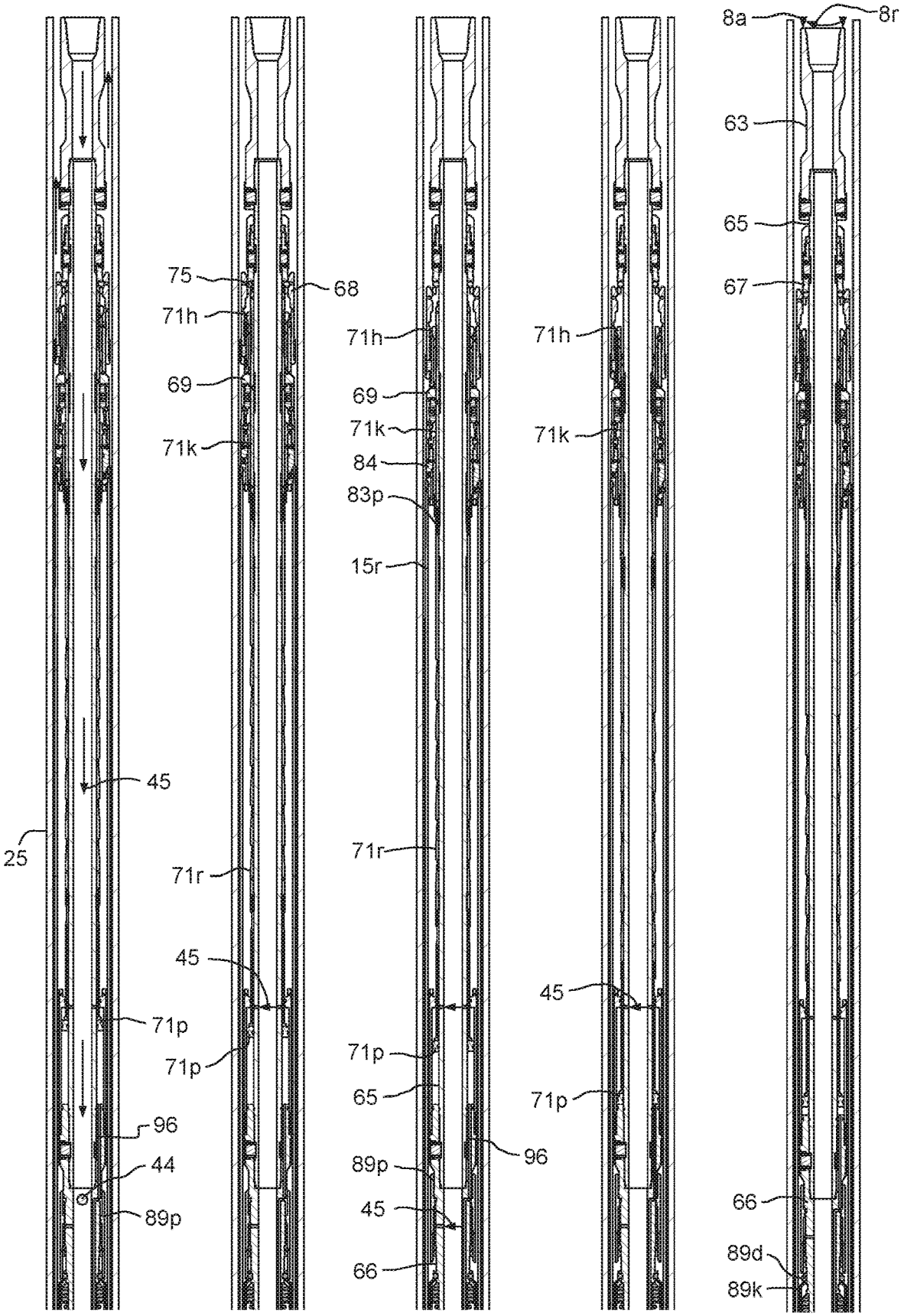
FIGS. 6A-6E and 8A-8E illustrate operation of an upper portion of the LDA.

The inner sleeve 67 may have one or more (pair shown) openings formed therethrough and spaced therearound to receive a respective dog 75 therein. Each dog 75 may extend into a groove formed in the inner surface of the outer sleeve 68, thereby fastening the inner and outer sleeves. Each dog 75 may be radially movable relative to the inner sleeve 67 between an extended position (shown) and a retracted position (FIG. 6C). Each dog 75 may be held in the extended position by interaction with a cam profile formed in an outer surface of the lock sleeve 71*k*. Each dog 75 may further have an upper lip, and outer lug. The lips may trap the dogs 75 between a stop profile formed in an inner surface of the inner sleeve 67 adjacent to the openings and the lock sleeve outer surface. Each outer lug may be chamfered to interact with chamfers of the outer sleeve groove to radially push the dogs 75 to the retracted position in response to longitudinal movement of the outer sleeve 68 relative to the inner sleeve 67. The lock sleeve 71*k* may initially be held in a position engaged with the dogs 75 by a shearable fastener 95 releasably connecting the push sleeve 71*h* to the housing 69.

The packer actuator 62 may include the housing 69, a keeper 78, a thrust bearing 79*t*, a radial bearing 79*r*, a fastener, such as snap ring 80, an indicator sleeve 81, and one or more (pair shown) shearable fasteners 82. The keeper 78, bearings 79*r,t*, and indicator sleeve 81 may be disposed in the housing 69. The snap ring 80 may be disposed in a groove formed in an inner surface of the keeper 78 and radially movable between an expanded position (shown) and a contracted position (FIG. 8B). The snap ring 80 may be trapped between the keeper 78 and a shoulder formed in an inner surface of the housing 69. The snap ring 80 may be naturally biased toward the contracted position and may engage one of the ratchet shoulders formed in an outer surface of the ratchet sleeve 71*r* in the contracted position, thereby longitudinally connecting the packer actuator 62 and the hanger actuator 61.

The radial bearing 79*r* may be disposed in a groove formed in an outer surface of the keeper 78. The thrust bearing 79*t* may be disposed between a lower face of the keeper 78 and an upper face of the indicator sleeve 81. The indicator sleeve may be connected the housing 69, such as by the shearable fasteners 82. The bearings 79*r,t* may facilitate rotation of the mandrel 65 and the keeper 78 relative to the rest of the packer actuator 62, thereby affording better weight transfer to the packer 15*p* during setting thereof. The shearable fasteners 82 may fracture when a threshold force is exerted on the indicator sleeve 81. The threshold force may correspond to a setting force of the packer 15*p*, such as equal to or slightly greater than, to provide confirmation that adequate setting force was exerted on the packer 15*p* to properly set the packer.

Figure 5A:
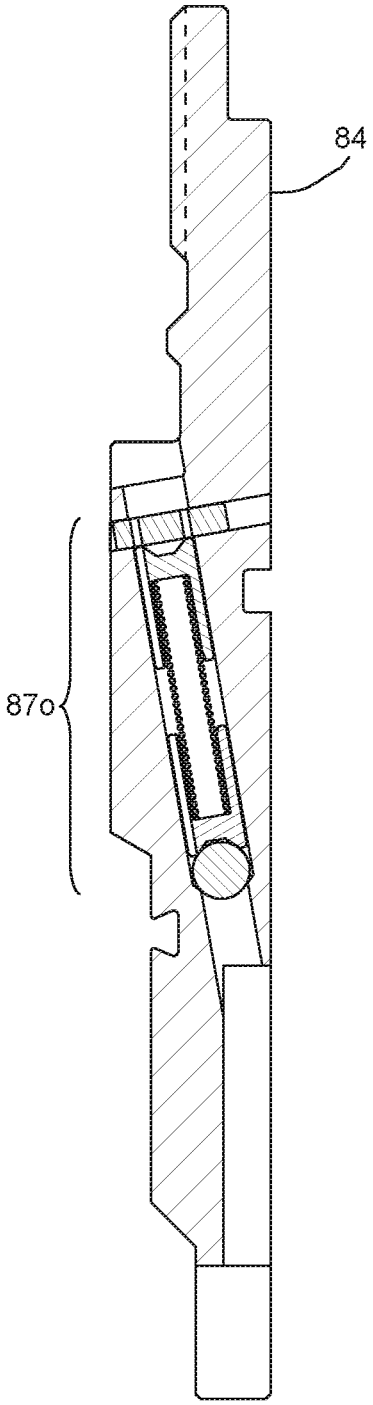
FIGS. 5A and 5B illustrate check valves of a debris barrier of the setting tool.
Figure 5B:
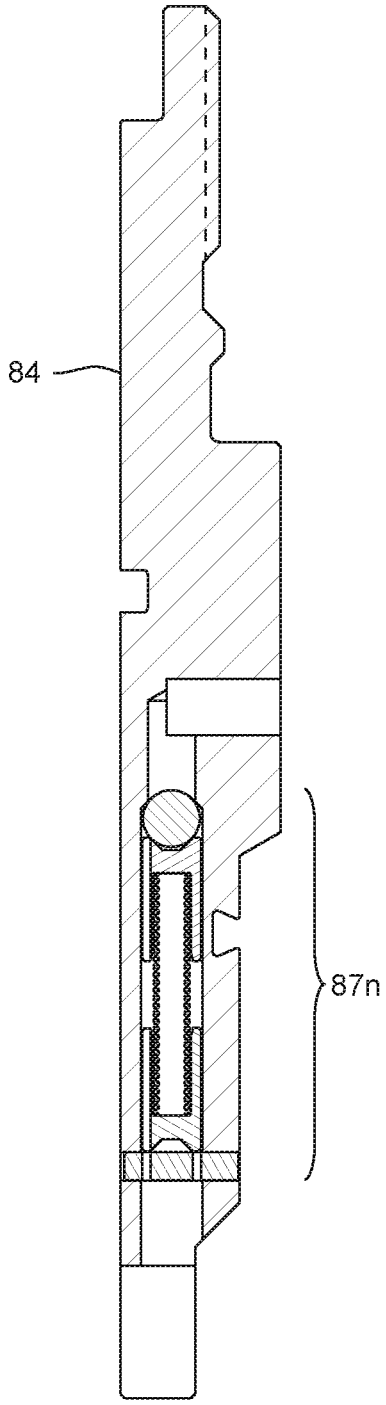
Figure 5C:
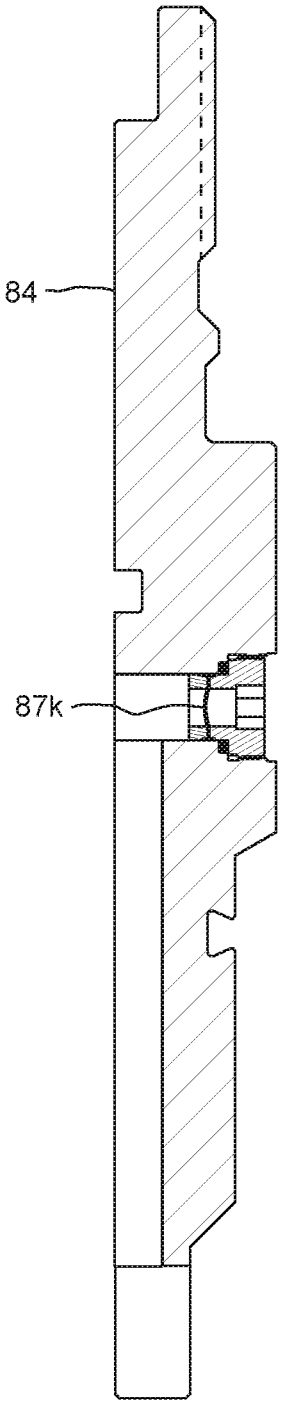
FIG. 5C illustrates a rupture disk of the debris barrier.

The debris barrier 51 may include a cap 84, a sleeve 85, a fastener, such as a dog 86, and one or more flow elements, such as an inlet check valve 87*n* (FIG. 5B), an outlet check valve 87*o* (FIG. 5A), and a rupture disk 87*k* (FIG. 5C). An upper end of the debris cap 84 may be connected to a lower end of the housing 69, such as by a threaded connection and/or fasteners. The debris sleeve 85 may be disposed around the lock sleeve 71*k* and the ratchet sleeve 71*r*. The lock sleeve 71*k* may carry a seal in an outer surface thereof in engagement with an inner surface of the debris sleeve 85, thereby sealing an interface therebetween. The debris sleeve 85 may have a support shoulder formed in an outer surface thereof and in engagement with a complementary shoulder formed in an inner surface of the debris cap 84, thereby supporting the debris sleeve from the debris cap. The debris cap 84 may carry a seal in an inner surface thereof in engagement with an outer surface of the debris sleeve 85, thereby sealing an interface therebetween. One or more (pair shown) shearable fasteners 88 may restrain the debris sleeve 85 in a lower engaged position relative to the debris cap 84. Once the shearable fasteners 88 have fractured (FIG. 8D), the debris sleeve 85 may be free to move longitudinally upward relative to the debris cap 84 to a disengaged position.

The debris cap 84 may an opening formed therethrough for receiving the dog 86 therein. The dog 86 may extend into a groove formed in the inner surface of the PBR 15*r*, thereby fastening the debris cap 84 to the PBR. The dog 86 may be radially movable relative to the debris cap 84 between an extended position (shown) and a retracted position (FIG. 8E). The dog 86 may be held in the extended position by interaction with a cam profile formed in an outer surface of the debris sleeve 85. The debris sleeve cam profile may be moved into the disengaged position by engagement of a top of the cylinder 72 with a bottom of the debris sleeve 85. The dog 86 may further have an inner lip and an outer lug. The lip may trap the dog 86 between a stop profile formed in the debris barrier opening and the debris sleeve outer surface. The lug may be chamfered to interact with chamfers of the PBR groove to radially push the dog 86 to the retracted position in response to longitudinal movement of the debris cap 84 relative to the PBR 15*r*.

The debris cap 84 may further have a load shoulder formed in an outer surface thereof for receiving a top of the PBR 15*r*. To ensure release of the PBR 15*r* should the debris sleeve 85 jam, the dog 86 may include an inner ring having a threaded bore and an outer shearable fastener. To assemble the dog 86, the shearable fastener may be screwed into the ring bore. The shearable fastener may then engage the PBR groove and may be fractured by pulling the workstring 9 until a threshold fracture force of the dog 86 is reached.

The debris cap 84 may further have a fill passage formed therethrough and closed by a plug. The debris cap 84 may further have a relief passage formed therethrough and closed by the rupture disk 87*k*. The debris cap 84 may have a torsion profile formed in a lower end thereof and the cylinder 72 may have a complementary torsion profile formed in an upper end thereof. The outer latch sleeve 68 may further have reamer blades formed in an upper face thereof. The torsion profiles may mate during removal of the LDA 9*d* from the liner string 15, thereby torsionally connecting the debris cap 84 to the setting mandrel 65. The outer sleeve 68 may then be rotated during removal to back ream debris accumulated adjacent an upper end of the PBR 15*r*.

To accommodate displacement of the buffer fluid during actuation of the LDA 9*d*, inlet and outlet passages (FIGS. 5A and 5B) may be formed in and along a wall of the debris cap 84 and a check valve 87*n,o* may be disposed in the respective passage. The inlet and outlet passages may provide regulated fluid communication between the buffer chamber and the annulus 48 to minimize contamination of the buffer chamber.

The running tool 53 may include the mandrel 66, a lock 89, a clutch 90, and a latch 91. The running mandrel 66 may have a bore formed therethrough and a seal sleeve 93 may carry an inner seal in engagement with a bottom of the running mandrel 66 and an outer seal in engagement with an inner surface of the upper catcher housing 92*u*, thereby isolating the bypass passage 96 from an upper portion of the LDA bore.

The latch 91 may longitudinally and torsionally connect the HP body 15*v* to an upper portion of the LDA 9*d*. The latch 91 may include a thrust cap 91*c*, a longitudinal fastener, such as a floating nut 91*n*, and a biasing member, such as a lower compression spring 91*s*. The thrust cap 91*c* may have an upper shoulder formed in an outer surface thereof and adjacent to an upper end thereof, an enlarged mid portion, a lower shoulder formed in an outer surface thereof, a torsional fastener, such as a key, formed in an outer surface thereof, a lead screw formed in an inner surface thereof, and a spring shoulder formed in an inner surface thereof. The key may mate with a torsional profile, such as a castellation, formed in an upper end of the HP body 15*v* and the floating nut 91*n* may be screwed into a thread 15*t* of the HP body. The lock 89 may prevent premature release of the latch from the PBR 15*r*. The clutch 90 may selectively torsionally connect the thrust cap 91*c* to the running mandrel 66.

The lock 89 may include one or more (pair shown) actuation ports formed through a wall of the running mandrel 66, a piston 89*p*, a plug 89*g*, one or more (pair shown) fasteners, such as dogs 89*d*, and a lock sleeve 89*k*. The plug 89*g* may be connected to an outer surface of the running mandrel 66, such as by threaded couplings. The plug 89*g* may carry an inner seal and an outer seal. The inner seal may isolate an interface formed between the plug 89*g* and the running mandrel 66 and the outer seal may isolate an interface formed between the plug and the piston 89*p*. The piston 89*p* may be longitudinally movable relative to the running mandrel 66 between an upper position (FIG. 6C) and a lower position (shown). The piston 89*p* may initially be fastened to the plug 89*g*, such as by one or more (pair shown) shearable fasteners 89*f*. In the lower position, the piston 89*p* may have an upper portion disposed around the running mandrel 66, a mid portion disposed along an outer surface of the plug 89*g*, and a lower portion received by the lock sleeve 89*k*, thereby locking the dogs 89*d* in a retracted position. The piston 89*p* may carry an inner seal in the upper portion for isolating an interface formed between the running mandrel 66 and the piston. An actuation chamber may be formed between the piston 89*p*, plug 89*g*, and the running mandrel 66 and be in fluid communication with the actuation ports.

The lock sleeve 89*k* may have an upper portion disposed along an outer surface of the running mandrel 66 and an enlarged lower portion. The lock sleeve 89*k* may have one or more (pair shown) openings formed through a wall thereof to receive the dogs 89*d* therein. The dogs 89*d* may be radially movable between the retracted position (shown) and an extended position (FIG. 6E). In the retracted position, the dogs 89*d* may extend into a groove formed in an outer surface of the running mandrel 66, thereby fastening the lock sleeve 89*k* to the running mandrel. The groove may have a tapered upper end for pushing the dogs 89*d* to the extended position in response to relative longitudinal movement therebetween.

The clutch 90 may include a biasing member, such as upper compression spring 90*s*, a thrust bearing 90*b*, a gear 90*g*, a lead nut 90*n*, and a torsional coupling, such as key 90*k*. The thrust bearing 90*b* may be disposed in the lock sleeve lower portion and against a shoulder formed in an outer surface of the running mandrel 66. A spring washer 90*w* may be disposed adjacent to a bottom of the thrust bearing 90*b* and may receive an upper end of the clutch spring 90*s*, thereby biasing the thrust bearing against a shoulder of the running mandrel 66. The running mandrel 66 may have a torsional profile, such a keyway formed in an outer surface thereof adjacent to a lower end thereof. The key 90*k* may be disposed the keyway.

The gear 90*g* may be connected to the thrust cap 91*c*, such as by a threaded fastener 90*f*, and may have teeth formed in an inner surface thereof. Subject to the lock 89, the gear 90*g* and thrust cap 91*c* may be movable between an upper position (FIGS. 6E and 7E) and a lower position (shown). In the lower position, the gear teeth may mesh with the key 90*k*, thereby torsionally connecting the thrust cap 91*c* to the running mandrel 66. The lead nut 90*n* may be engaged with the lead screw of the thrust cap 91*c* and have a keyway formed in an inner surface thereof and engaged with the key 90*k*, thereby longitudinally connecting the lead nut and the thrust cap while providing torsional freedom therebetween and torsionally connecting the lead nut and the running mandrel 66 while providing longitudinal freedom therebetween. A lower end of the clutch spring 90*s* may bear against an upper end of the gear 90*g*. The thrust cap 91*c* and gear 90*g* may initially be trapped between a lower end of the lock sleeve 89*k* and top of the HP body 15*v*.

The spring shoulder of the thrust cap 91*c* may receive an upper end of the latch spring 91*s*. A lower end of the latch spring 91*s* may be received by a shoulder formed in an upper end of the floating nut 91*n*. A thrust ring 91*t* may be disposed between the floating nut 91*n* and a top of the catcher upper housing 92*u*. The floating nut 91*n* may be urged against the thrust ring 91*t* by the latch spring 91*s*. The floating nut 91*n* may have a thread formed in an outer surface thereof. The thread may be opposite-handed, such as left handed, relative to the rest of the threads of the workstring 9. The floating nut 91*n* may be torsionally connected to the running mandrel 66 by having a keyway formed along an inner surface thereof and receiving the key 90*k*, thereby providing upward freedom of the floating nut 91*n* relative to the running mandrel 66 while maintaining torsional connection thereto. Threads of the lead nut 90*n* and lead screw of the thrust cap 91*c* may have a finer pitch, opposite hand, and greater number than threads of the floating nut 91*n* and HP body 15*v* to facilitate lesser (and opposite) longitudinal displacement per rotation of the lead nut relative to the float nut.

The catcher 54 may include the upper housing 92*u*, a lower housing 92*w* and a mechanical ball seat 94. The lower housing 92*w* may be connected to the upper housing 92*u*, such as by threaded couplings and/or fasteners. The mechanical ball seat 94 may include a body 94*y* and a seat 94*s* fastened to the body, such as by one or more shearable fasteners 94*f*. The seat 94*s* may also be linked to the body by a cam and follower. The seat 94*s* may catch the ball 44 and the seat and caught ball may divide the LDA bore into the upper portion and the lower portion. Once the ball 44 is caught, the seat 94*s* may be released from the body 94*y* by a threshold pressure exerted on the ball. The threshold pressure may be greater than a pressure required to set the liner hanger 15*h*, greater than a pressure required to unlock the running tool 53, and greater than a pressure necessary to fracture the shearable fasteners 74. Once released, the seat and ball 44 may swing relative to the body into a capture chamber, thereby reopening the LDA bore.

FIGS. 6A-6E and 8A-8E illustrate operation of an upper portion of the LDA 9*d*. FIGS. 7A-7E and 9A-9E illustrate operation of a lower portion of the LDA 9*d*.

Figures 7A, 7B, 7C, 7D, 7E:
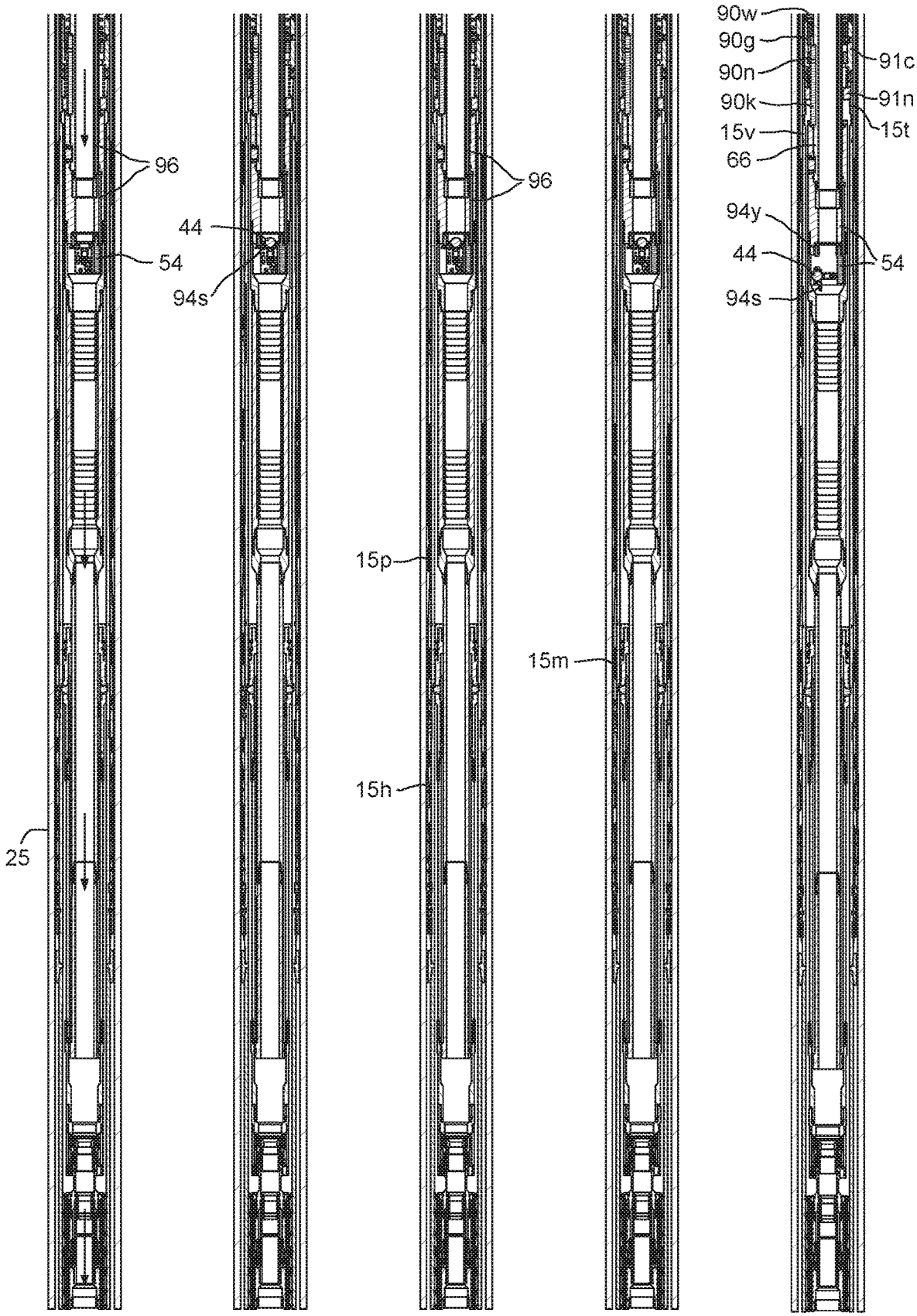
FIGS. 7A-7E and 9A-9E illustrate operation of a lower portion of the LDA.

Referring specifically to FIGS. 6A and 7A, as the liner string 15 is being advanced 8*a* into the wellbore 24 by the workstring 9, resultant surge pressure of the drilling fluid 47*m* may be communicated to the lower face of the actuator piston 71*p* via the bypass passage 96. The surge pressure may also be communicated to an upper face of the running tool piston 89*p* via a bypass port 97 (FIG. 4C) formed in a wall of the running mandrel 66 and in fluid communication with the bypass passage 96. This communication of the surge pressure by the bypass passage 96 and the bypass port 97 to the lower face of the actuator piston 71*p* and the upper face of the lock piston 89*p* may negate tendency of the surge pressure communicated to an upper face of the actuator piston and to the lower face of the running tool piston by the mandrel ports from prematurely setting the liner hanger 15*h* and prematurely unlocking the running tool 53. Once the liner string 15 has been advanced 8*a* into the wellbore 24 by the workstring 9 to a desired deployment depth and the cementing head 7 has been installed, conditioner 45 may be circulated by the cement pump 13 through the valve 41 to prepare for pumping of cement slurry 46. The ball launcher 7*s* may then be operated and the conditioner 45 may propel the ball 44 down the workstring 9 to the catcher 54. The ball 44 may land in the seat 94*s* of the catcher 54.

Referring specifically to FIGS. 6B and 7B, once the ball 44 has landed, continued pumping of the conditioner 45 may increase pressure on the seated ball, thereby also pressurizing the actuation chamber and exerting pressure on the actuator piston 71*p*. The actuator piston 71*p* may in turn exert a release force on the shearable fastener 95 via the ratchet sleeve 71*r*, the lock sleeve 71*k*, and the push sleeve 71*h*. The actuator housing 69 may be restrained from moving via the outer latch sleeve 68 and the engaged dogs 75. Once a first threshold pressure on the actuator piston 71*p* has been reached, the shearable fastener 95 may fracture, thereby releasing the lock sleeve 71*k* from the actuator housing 69. The lock sleeve 71*k* may move downward from engagement with the dogs 75 until the push sleeve 71*h* engages a shoulder formed in an inner surface of the actuator housing 69.

Referring specifically to FIGS. 6C and 7C, engagement of the push sleeve 71*h* with the actuator housing 69 may exert a setting force thereon. The actuator housing 69 may in turn exert the setting force on the debris cap 84 via engagement of a bottom of the actuator housing with a load shoulder formed in an outer surface of the debris cap. The debris cap 84 may in turn exert the setting force on the PBR 15*r* via engagement of the load shoulder thereof with a top of the PBR. The PBR 15*r* may in turn exert the setting force on the liner hanger upper portion via the packer 15*p*. The liner hanger upper portion may initially be restrained from setting the liner hanger 15*h* by the shearable fastener 15*y*. Once a second threshold pressure on the actuator piston 71*p* has been reached, the shearable fastener 15*y* may fracture, thereby releasing the liner hanger upper portion.

The actuator piston 71*p*, ratchet sleeve 71*r*, lock sleeve 71*k*, push sleeve 71*h*, actuator housing 69, debris cap 84, PBR 15*r*, packer 15*p*, and liner hanger upper portion may travel downward until slips of the liner hanger 15*h* are set against the casing 25, thereby halting the movement. As the downward movement is occurring, the shearable pins 73 of the may engage the bottoms of the setting mandrel slots and fracture, thereby releasing the lock sleeve 71*k* from the setting mandrel 65. Also as the downward movement is occurring, the snap ring 83*p* carried by the ratchet sleeve 71*r* may engage the latch profile of the setting mandrel. Also as the downward movement is occurring, the buffer fluid displaced from the buffer chamber may open the outlet check valve 87*o* and may be discharged into the annulus 48 via the outlet passage. Drilling fluid 47*m* displaced from the actuation chamber may be discharged from the actuation chamber lower portion into LDA lower bore via the bypass passage 96.

Continued pumping of the conditioner 45 to set the liner hanger 15*h* may also pressurize the running tool actuation chamber and exert pressure on the lock piston 89*p*. Once a third threshold pressure on the lock piston 89*p* has been reached, the shearable fasteners 89*f* may fracture, thereby releasing the lock piston. The lock piston 89*p* may travel upward until an upper end thereof engages a shoulder formed in an outer surface of the running mandrel 66, thereby halting the movement.

Referring specifically to FIGS. 6D and 7D, continued pumping of the conditioner 45 may further pressurize the actuation chamber until a fourth threshold pressure is reached, thereby fracturing the shearable fasteners 74 and releasing the push sleeve 71*h* from the lock sleeve 71*k* (and actuator piston 71*p*). The liner hanger 15*h* may be restrained from unsetting by the lower ratchet connection 15*m*. Downward movement of the actuator piston 71*p*, ratchet sleeve 71*r*, and lock sleeve 71*k*, may continue until the actuator piston reaches a lower end of the actuation chamber.

Referring specifically to FIGS. 6E and 7E, setting of the liner hanger 15*h* may be confirmed (not shown), such as by slacking the pipe string 9*p* using the drawworks 12. Continued pumping of the conditioner 45 may further pressurize the upper LDA bore until a fifth threshold pressure is reached, thereby releasing the fracturing the shearable fastener 94*f* and releasing the catcher seat 94*s* from the catcher body 94*y*. The catcher seat 94*s* and ball 44 may swing relative to the catcher body 94*y* into the capture chamber, thereby reopening the LDA bore.

The pipe string 9*p*, adapter 63, setting mandrel 65, latch inner sleeve 67, running mandrel 66, and catcher 54 may then be lowered 8*a*, thereby causing the HP body 15*v* to exert a reactionary force on the thrust cap 91*c* and running lock sleeve 89*k*, thereby pushing the running dogs 89*d* against the groove taper. The running dogs 89*d* may be pushed to the extended position, thereby releasing the thrust cap 91*c* and running lock sleeve 89*k*. Lowering 8*a* may continue, thereby disengaging the gear 90*g* from the key 90*k*. The lowering 8*a* may be halted by engagement of the thrust cap upper end with a lower end of the spring washer 90*w*.

The pipe string 9*p*, setting mandrel 65, and running mandrel 66 may then be rotated 8*r* from surface by the top drive 5 to cause the lead nut 90*n* to travel down the thrust cap lead screw while the floating nut 91*n* travels upward relative to the thread 15*t* of the HP body 15*v*. The floating nut 91*n* may disengage from the HP body thread 15*t* before the running tool lead nut 90*n* bottoms out in the threaded passage. The rotation 8*r* may be halted by the running tool lead nut bottoming out against a lower end of the thrust cap lead screw, thereby restoring torsional connection between the thrust cap 91*c* and the running mandrel 66.

Referring specifically to FIGS. 8A and 9A, the pipe string 9*p*, hanger actuator 61 (except for the push sleeve 51*h*), adapter 63, setting mandrel 65, latch inner sleeve 67, running tool 53, and catcher 54 may then be raised and then lowered (not shown) to confirm release of the running tool 53. The ratchet sleeve 71*r*, setting mandrel 65, and PBR 15*r* may have sufficient length to accommodate the raising without engaging the cylinder 72 with the debris sleeve 85. The spacer 58 and stinger 57 may also have sufficient length to accommodate the raising without engaging the release 59 with the packoff 56.

The workstring 9 and liner string 15 (except for the set hanger 15*h*) may then be rotated 8*r* from surface by the top drive 5 and rotation may continue during the cementing operation. Rotation of the rest of the liner string 15 relative to the set hanger 15*h* may be facilitated by the thrust bearing 15*b*. The bottom dart 43*b* may be released from the bottom launcher 7*b* by operating the bottom plug launcher actuator. Cement slurry 46 may be pumped from the mixer 42 into the cementing swivel 7*c* via the valve 41 by the cement pump 13. The cement slurry 46 may flow into the top launcher 7*u* and be diverted past the top dart 43*u* via the diverter and bypass passages. The cement slurry 46 may flow into the bottom launcher 7*b* and be forced behind the bottom dart 43*b* by closing of the bypass passages, thereby propelling the bottom dart into the workstring bore.

Once the desired quantity of cement slurry 46 has been pumped, the top dart 43*u* may be released from the top launcher 7*u* by operating the top plug launcher actuator. Chaser fluid 49 may be pumped into the cementing swivel 7*c* via the valve 41 by the cement pump 13. The chaser fluid 49 may flow into the top launcher 7*u* and be forced behind the top dart 43*u* by closing of the bypass passages, thereby propelling the top dart into the workstring bore. Pumping of the chaser fluid 49 by the cement pump 13 may continue until residual cement in the cement line 14 has been purged. Pumping of the chaser fluid 49 may then be transferred to the mud pump 34 by closing the valve 41 and opening the valve 6. The train of darts 43*u,b* and slurry 46 may be driven through the workstring bore by the chaser fluid 49. The bottom dart 43*b* may reach the bottom wiper plug 55*b*, seat therein, and the bottom dart and plug may be released from the plug release system 55.

The top dart 43*u* may reach the top wiper plug 55*u*, seat therein, and the top dart and plug may be released from the plug release system 55. Continued pumping of the chaser fluid 49 may drive the train of darts 43*u,b*, wiper plugs 55*u,b*, and slurry 46 through the liner bore. The bottom dart and plug may land into the collar 15*c* and continued pumping of the chaser fluid 49 may rupture the burst tube of the bottom plug 55*b*, thereby allowing the slurry 46 to flow through the bottom dart and plug, the reamer shoe 15*s*, and into the annulus 48. Pumping of the chaser fluid 49 may continue until a desired quantity thereof has been pumped or the top dart 43*u* and top wiper plug 55*u* land onto the seated bottom dart 43*b* and wiper plug 55*b*.

Referring specifically to FIGS. 8B and 9B, pumping of the chaser fluid 49 may be halted and rotation 8*r* of the workstring 9 may be halted. The pipe string 9*p*, hanger actuator 61 (except for the push sleeve 51*h*), adapter 63, setting mandrel 65, latch inner sleeve 67, running tool 53, and catcher 54 may be raised until the snap ring 80 engages one of the shoulders of the ratchet sleeve 71*r*.

Referring specifically to FIGS. 8C and 9C, rotation 8*r* of the workstring 9 may resume and the pipe string 9*p*, adapter 63, setting mandrel 65, running tool 53, and catcher 54 may be lowered until the snap ring 83*p* engages the straight shoulder of the setting mandrel. Lowering of the pipe string 9*p*, setting tool 52, running tool 53, and catcher 54 may continue, thereby exerting weight on the PBR 15*r*. The PBR 15*r* may in turn exert the weight on the packer upper portion. The shearable fastener 15*x* of the releasable connection 15*w,x* may engage the bottom of the slot 15*w* and fracture, thereby releasing the packer upper portion from the HP body 15*v*. The packing element may be driven along the wedge and expanded into engagement with the casing 25, thereby halting the movement. The shearable fasteners 82 may then fracture, thereby indicating successful setting of the packer 15*p*. The packer 15*p* may be restrained from unsetting by the upper ratchet connection 15*k*.

Referring specifically to FIGS. 8D and 9D, the pipe string 9*p*, hanger actuator 61 (except for the push sleeve 51*h*), adapter 63, setting mandrel 65, latch inner sleeve 67, running tool 53, and catcher 54 may be raised until the cylinder top engages the debris sleeve bottom. Continued raising may exert the threshold force to fracture the shearable fasteners 88, thereby releasing the debris sleeve 85 from the debris cap 84. Continued raising may move the debris sleeve cam profile from engagement with the dog 86 and engage the torsional profile of the cylinder 72 with the torsional profile of the debris cap 84. The debris cap 84 may then be carried by the cylinder 72 with continued raising and engagement of the dog 86 with a top of the PBR latch profile may push the dog inward to the retracted position, thereby releasing the debris barrier 51 from the PBR 15*r*. During the release of the debris cap 84, the conditioner 45 may be suctioned from the annulus 48 into the buffer chamber via the open inlet check valve 87*n* and the inlet passage to prevent hydraulic lock of the debris cap. Rotation may continue during the raising so that the blades of the outer latch sleeve 68 may ream any excess cement slurry 46.

Referring specifically to FIGS. 8E and 9E, raising of the pipe string 9*p*, setting tool 52, running tool 53, and catcher 54 may continue until the release 59 engages the lock sleeve of the packoff 56, fractures the shearable fasteners thereof, and moves the lock sleeve to the release position, thereby allowing retraction of the packoff dogs and releasing the packoff from the HP body 15*v*. Once the packoff 56 exits the PBR 15*r*, the chaser fluid 49 may be circulated to wash away the excess cement slurry 46. The workstring 9 may then be retrieved to the MODU 1*m*.

Advantageously, keeping the buffer chamber intact until after the packer 15*p* is set allows less time for the excess cement slurry 46 to fall in the PBR 15*r* and possibly set therein. In prior art operations, a step of deploying a dressing mill to clean out the PBR 15*r* before installing a tieback casing string (not shown) into the PBR 15*r* is often necessary as the excess cement slurry 46 set in the PBR 15*r* may compromise integrity of a tieback seal of the tieback casing string. Since circulation of the chaser fluid 49 may begin immediately after the buffer chamber is opened, the need to perform a cleanout operation of the PBR may be minimized or even obviated.

Alternatively, the setting tool 52 may be used to drive an expander through an expandable liner hanger. Alternatively, the setting tool 52 may be used to hang a casing string from a subsea wellhead. Alternatively, the liner string 15 may be hung from another liner string instead of the casing string 25.

Alternatively, drilling fluid may be injected into the liner string 15 and the liner string may include a drilling assembly (not shown), such as a drillable drill bit, instead of the reamer shoe 15*s* and the liner string may be drilled into the lower formation 27*b*, thereby extending the wellbore 24 while deploying the liner string.

Alternatively, liner string 15 may be lowered into the wellbore 24 using a flowback tool without rotation thereof and without injecting drilling fluid therethrough. The LDA 9*d* may further include a diverter valve (not shown) connected between the adapter 63 and a lower end of the pipe string 9*p* and drilling fluid may not be circulated during deployment of the liner string 15. The diverter valve may include a housing, a bore valve, and a port valve. The bore valve may include a body and a valve member, such as a flapper, pivotally connected to the body and biased toward a closed position, such as by a torsion spring. The flapper may be oriented to allow downward fluid flow from the pipe string 9*p* through the rest of the LDA 9*d* and prevent reverse upward flow from the LDA to the pipe string 9*p*. Closure of the flapper may isolate an upper portion of a bore of the diverter valve from a lower portion thereof. The port valve may include a sleeve and a biasing member, such as a compression spring. The sleeve may include two or more sections connected to each other, such as by threaded couplings and/or fasteners. An upper section of the sleeve may be connected to a lower end of the bore valve body, such as by threaded couplings.

Figure 10:
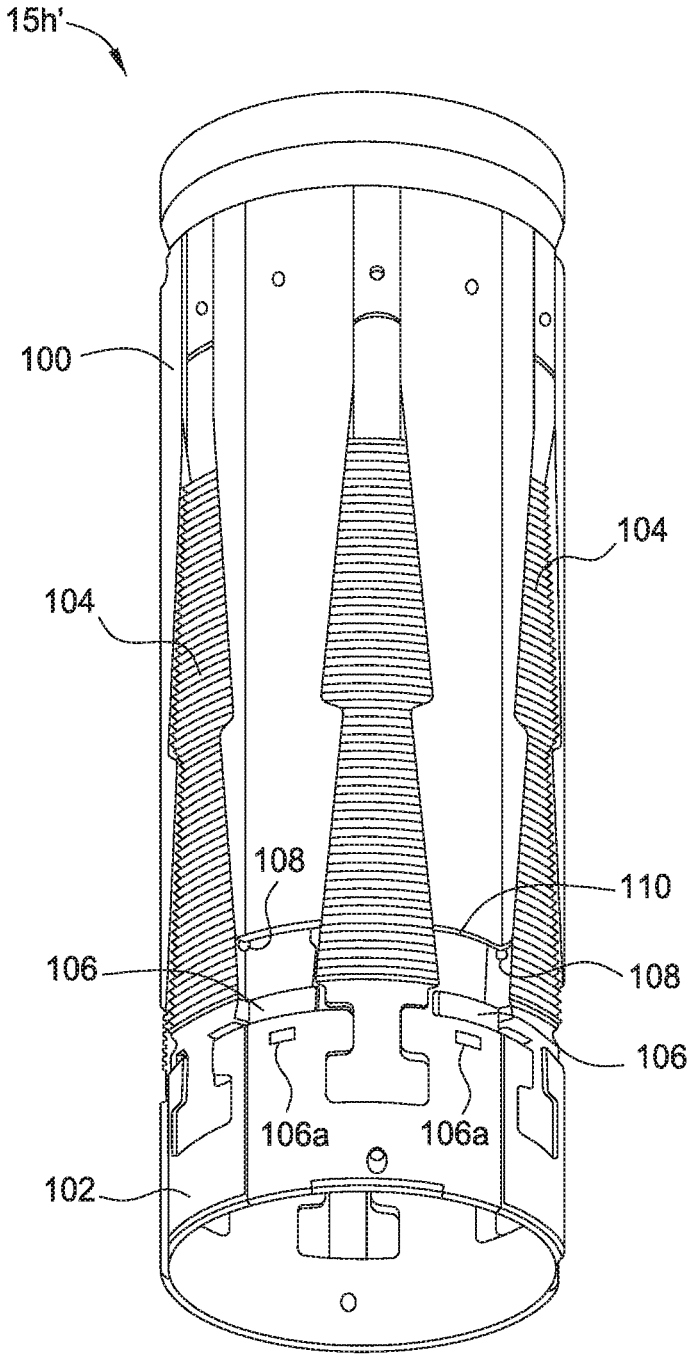
FIG. 10 illustrates an alternative liner hanger, according to another embodiment of this disclosure.

The diverter sleeve may be disposed in the housing and longitudinally movable relative thereto between an upper position and a lower position. The diverter housing may have one or more flow ports and one or more equalization ports formed through a wall thereof. The sleeve may have one or more equalization slots formed therethrough providing fluid communication between a spring chamber formed in an inner surface of the housing and a lower bore portion of the diverter valve. The sleeve may cover the housing flow ports when the sleeve is in the lower position, thereby closing the housing flow ports and the sleeve may be clear of the flow ports when the sleeve is in the upper position, thereby opening the flow ports. In operation, surge pressure of the returns 47*r* generated by deployment of the LDA 9*d* and liner string 15 into the wellbore may be exerted on a lower face of the closed flapper. The surge pressure may push the flapper upward, thereby also pulling the sleeve upward against the compression spring and opening the housing flow ports. The surging returns 47*r* may then be diverted through the open flow ports by the closed flapper. Once the liner string 15 has been deployed, dissipation of the surge pressure may allow the spring to return the sleeve to the lower position FIG. 10 illustrates an alternative liner hanger 15*h*', according to another embodiment of this disclosure. The alternative liner hanger 15*h*' may be assembled with the liner string 15 instead of the liner hanger 15*h*. The alternative liner hanger 15*h*' may include a cam 100, a slip carrier 102, a plurality of slips 104, one or more stops 106, and one or more, such as a pair, of shearable fasteners 108 for each slip. The slips 104 may be spaced around the alternative liner hanger 15*h*' at regular intervals, such as three at one hundred twenty degrees, four at ninety degrees, or six at sixty degrees. The cam 100 may be tubular and have a pocket formed through a wall thereof for each slip 104.

Each slip 104 may be arcuate, may have teeth formed in an outer surface thereof, and may be made from a hard material, such as tool steel, ceramic, or cermet, for engaging and penetrating an inner surface of the casing 25, thereby anchoring the alternative liner hanger 15*h*' to the casing. Each slip 104 may have upper and mid portions each shaped like an arrowhead and a lower I-shaped tongue portion. The slip carrier 102 may have complementary grooves formed therethrough for receiving the tongue portions of the slips 104, thereby longitudinally and torsionally connecting the slips to the slip carrier while allowing relative radial movement therebetween. Each slip 104 may be disposed in a respective pocket. Each pocket may have a ramp formed in an upper portion of each side thereof for interaction with sides of the respective slip for radially moving the respective slip between an extended position (not shown) and a retracted position (shown) in response to longitudinal downward movement of the cam relative to the slips.

Advantageously, having the inclination on the sides of the cam 100 instead of the outer surface of a cone results in circumferential loading of the casing string 25 instead of radial loading, thereby conforming to the shape of the casing bore without imposing burst loads upon the casing or collapse loads on the HP body 15*v*.

The cam 100 may have a recess formed in the outer surface thereof at a lower end thereof, thereby forming a stop shoulder 110 therein. The shearable fasteners may be screws received in threaded sockets formed in the sides of the slips. Heads of the screws may protrude from the sides of the slips and may engage the stop shoulder 110, thereby preventing premature actuation of the alternative liner hanger until a threshold force has been exerted on the cam by the PBR 15*r*. The stops 106 may have hooks 106*a* formed in outer surfaces thereof in engagement with slots formed through a wall of the slip carrier. The stops 106 may be located between adjacent slips and over the recess of the cam to prevent overextension of the alternative liner hanger from jettisoning the slips, such as if the casing 25 was corroded.

The cam 100 and the slip carrier 102 may have aligned flow channels formed in and along outer surfaces thereof. The flow channels may be located between adjacent slips 104. Each slip 104 may also a flow channel formed in and along an inner surface thereof. The cam 100 and the slip carrier 104 may have flow ports formed through walls thereof adjacent to respective longitudinal ends of the slips for providing a flow path along the alternative liner hanger in conjunction with the flow channels of the slips.

In one or more of the embodiments described herein, an assembly for hanging a tubular string in a wellbore includes a packoff including a fastener and a seal for engaging an inner surface of the tubular string; and a setting tool. The setting tool includes: a debris cap for engaging an upper end of the tubular string, thereby forming a buffer chamber between the debris cap and the packoff; a mandrel having a port formed through a wall thereof; a piston disposed along the mandrel, having an upper face in fluid communication with the port, and operable to stroke the debris cap relative to the mandrel, thereby setting a hanger of the tubular string; an actuator sleeve extending along the mandrel and connected to the piston; a packer actuator including a housing connected to the debris cap above the buffer chamber and a fastener for engaging a profile of the actuator sleeve; and a latch releasably connecting the housing to the mandrel.

In one or more of the embodiments described herein, the latch includes an inner sleeve connected to the mandrel; an outer sleeve connected to the housing; and a fastener releasably connecting the inner and outer sleeves.

In one or more of the embodiments described herein, the actuator sleeve includes a ratchet sleeve and a lock sleeve, and the setting tool further includes a push sleeve releasably connected to the outer sleeve and releasably connected to the lock sleeve, and the push sleeve holds the lock sleeve in a position engaged with the fastener of the latch.

In one or more of the embodiments described herein, the setting tool further includes a shearable pin carried by the lock sleeve, the mandrel has a slot formed in and along an outer surface thereof for receiving the shearable pin, the setting tool further includes a fastener carried by the actuator sleeve for engaging a profile formed in the outer surface of the mandrel, and the profile has an upper straight shoulder for connecting the mandrel and the actuator sleeve in a downward direction.

In one or more of the embodiments described herein, the setting tool further includes a debris sleeve and a dog, the dog is disposed in an opening formed through a wall of the debris cap and movable between an extended position and a retracted position, the debris sleeve has a cam profile formed in an outer surface thereof for holding the dog in the extended position, and the system further includes a shearable fastener releasably connecting the debris sleeve to the debris cap.

In one or more of the embodiments described herein, the dog has an inner ring and a shearable fastener connected to the inner ring for engaging the tubular string.

In one or more of the embodiments described herein, the setting tool further includes a cylinder connected to the mandrel, an actuation chamber is formed between the cylinder and the mandrel, and at least a portion of the piston is disposed in the actuation chamber and divides the chamber into an upper portion and a lower portion.

In one or more of the embodiments described herein, a lower end of the debris cap has a torsion profile formed therein, an upper end of the cylinder has a torsion profile formed therein, the torsion profiles are complementary, thereby being operable to torsionally connect the debris barrier and the cylinder, the latch comprises an outer sleeve connected to the housing, and the outer sleeve has reamer blades formed in an upper face thereof.

In one or more of the embodiments described herein, a shoulder of the cylinder is engageable with a bottom of the debris sleeve, thereby disengaging the cam profile from the dog.

In one or more of the embodiments described herein, the debris cap has an inlet passage and an outlet passage formed therethrough, and the setting tool further includes an inlet check valve disposed in the inlet passage and an outlet check valve disposed in the outlet passage.

In one or more of the embodiments described herein, the debris cap has a fill passage formed therethrough closed by a plug, and the debris cap has a relief passage formed therethrough closed by a rupture disk.

In one or more of the embodiments described herein, the packer actuator further includes: a keeper disposed in the housing; an indicator sleeve disposed in the housing; a shearable fastener releasably connecting the indicator sleeve to the housing; a thrust bearing disposed between the keeper and the indicator sleeve; and a radial bearing disposed between the keeper and the housing.

In one or more of the embodiments described herein, the assembly further includes: a catcher having a seat for receiving a setting plug; a passage for being in fluid communication with a lower face of the piston and bypassing the seat.

In one or more of the embodiments described herein, the assembly further includes: a running tool connectable to the mandrel and operable to longitudinally and torsionally connect to the tubular string, wherein the catcher is connectable to the running tool, and the passage is formed in and along a wall of the running tool and formed in and along a wall of the catcher.

In one or more of the embodiments described herein, the running tool includes: a running mandrel connectable to the mandrel of the setting tool; a latch for releasably connecting the tubular string to the running mandrel and including: a longitudinal fastener for engaging a longitudinal profile of the tubular string; and a torsional fastener for engaging a torsional profile of the tubular string; a lock keeping the latch engaged in the locked position; a piston for releasing the lock and having a lower face in fluid communication with a bore of running mandrel and an upper face in fluid communication with the passage; and a clutch for selectively torsionally connecting the torsional fastener to the body.

In one or more of the embodiments described herein, the catcher is operable to release the seat and the setting plug from a body thereof and move the seat and the setting plug into a capture chamber.

In one or more of the embodiments described herein, the assembly further includes: a damper connectable to the catcher; a stinger connectable to the damper; a release connectable to the stinger; a spacer connectable to the packoff; and a plug release system connectable to the spacer and including: an equalization valve; and a wiper plug releasably connected to the equalization valve and operable to engage the inner surface of the tubular string.

In one or more embodiments described herein, a system includes: the assembly of one or more of the embodiments described herein; and the tubular string including: a polished bore receptacle (PBR) for engagement with the debris cap; a packer connected to the PBR and having a metallic gland carrying an outer seal and an inner seal and a wedge operable to expand the metallic gland; a hanger having an upper portion connected to the packer; a body carrying the hanger and packer and having a latch profile for engagement with the running tool; and a shearable fastener connecting the hanger upper portion to the body.

In one or more embodiments described herein, a method of hanging a tubular string in a wellbore includes: running the tubular string into the wellbore using a pipe string and a deployment assembly having: a debris cap releasably connected to and closing an upper end of the tubular string, a packoff releasably connected to and engaged with the tubular string, and a buffer fluid disposed in a chamber formed between the debris cap and the packoff; pumping a setting plug through the pipe string to the deployment assembly, thereby operating a piston thereof to set a hanger of the tubular string; after setting the hanger, lowering the pipe string, thereby setting a packer of the tubular string; and after setting the packer, raising the pipe string, thereby releasing the debris cap and opening the chamber of the buffer fluid.

In one or more of the embodiments described herein, the deployment assembly further has a mandrel and a seat connected to the mandrel, the piston has an upper face in communication with a port formed through the mandrel above the seat, and the setting plug is pumped to the seat.

In one or more of the embodiments described herein, the deployment assembly further has a packer actuator disposed above and connected to the debris cap, the debris cap is releasably connected to the mandrel, the piston also releases the debris barrier from the mandrel, and the method further comprises, after setting the hanger and before setting the packer, raising the mandrel and the piston, thereby engaging the packer actuator with the piston.

In one or more of the embodiments described herein, the piston has a lower face in communication with a bore of the deployment assembly below the seat via a bypass passage.

In one or more of the embodiments described herein, the deployment assembly further has a running tool connected to the mandrel and longitudinally and torsionally fastening the tubular string to the deployment string, and the bypass passage is formed in and along a wall of the running tool.

In one or more of the embodiments described herein, the running tool is unlocked in response to pumping the setting plug to the deployment assembly, the method further comprises releasing the running tool by lowering and then rotating the deployment string, and the debris cap remains stationery while lowering the deployment string.

In one or more of the embodiments described herein, a setting force of the packer is substantially greater than a setting force of the hanger, and setting of the hanger by the piston is transmitted through the packer.

In one or more of the embodiments described herein, the deployment assembly further includes a plug release system, and the method further comprises, after setting the hanger and before setting the packer: pumping cement slurry into the pipe string; launching a dart into the pipe string; pumping chaser fluid into the pipe string, thereby driving the dart and cement slurry through the pipe string and deployment assembly and seating the dart into a wiper plug of the plug release system.

In one or more of the embodiments described herein, the pipe string is further raised after opening the chamber of buffer fluid, thereby releasing the packoff from the tubular string.

In one or more of the embodiments described herein, the method further includes retrieving the deployment assembly from the wellbore after releasing the packoff from the tubular string.

While the foregoing is directed to embodiments of the present disclosure, other and further embodiments of the disclosure may be devised without departing from the basic scope thereof, and the scope of the invention is determined by the claims that follow.

The invention claimed is:

1. An assembly for hanging a tubular string in a wellbore, comprising:

a packoff comprising a fastener and a seal for engaging an inner surface of the tubular string; and a setting tool, comprising:

a debris cap for engaging an upper end of the tubular string, thereby forming a buffer chamber between the debris cap and the packoff;

a mandrel having a port formed through a wall thereof;

a piston: disposed along the mandrel, having an upper face in fluid communication with the port, and operable to stroke the debris cap relative to the mandrel, thereby setting a hanger of the tubular string;

an actuator sleeve extending along the mandrel and connected to the piston;

a packer actuator comprising a housing connected to the debris cap above the buffer chamber and a fastener for engaging a profile of the actuator sleeve, wherein the packer actuator is disposed above the buffer chamber; and a latch releasably connecting the housing to the mandrel.

2. The assembly of claim 1, wherein the latch comprises:

an inner sleeve connected to the mandrel;

an outer sleeve connected to the housing; and a fastener releasably connecting the inner and outer sleeves.

3. The assembly of claim 2, wherein:

the actuator sleeve comprises a ratchet sleeve and a lock sleeve, the setting tool further comprises a push sleeve releasably connected to the outer sleeve and releasably connected to the lock sleeve, and the push sleeve holds the lock sleeve in a position engaged with the fastener of the latch.

4. The assembly of claim 3, wherein:

the setting tool further comprises a shearable pin carried by the lock sleeve, the mandrel has a slot formed in and along an outer surface thereof for receiving the shearable pin, the setting tool further comprises a fastener carried by the actuator sleeve for engaging a profile formed in the outer surface of the mandrel, and the profile has an upper straight shoulder for connecting the mandrel and the actuator sleeve in a downward direction.

5. The assembly of claim 4, wherein:

the setting tool further comprises a debris sleeve and a dog, the dog is disposed in an opening formed through a wall of the debris cap and movable between an extended position and a retracted position, the debris sleeve has a cam profile formed in an outer surface thereof for holding the dog in the extended position, and a shearable fastener releasably connecting the debris sleeve to the debris cap.

6. The assembly of claim 4, wherein:

the setting tool further comprises a cylinder connected to the mandrel, an actuation chamber is formed between the cylinder and the mandrel, and at least a portion of the piston is disposed in the actuation chamber and divides the chamber into an upper portion and a lower portion.

7. The assembly of claim 5, wherein:

a lower end of the debris cap has a torsion profile formed therein, an upper end of the cylinder has a torsion profile formed therein, the torsion profiles are complementary, thereby being operable to torsionally connect the debris barrier and the cylinder, the latch comprises an outer sleeve connected to the housing, and the outer sleeve has reamer blades formed in an upper face thereof.

8. The assembly of claim 5, wherein:

the debris cap has an inlet passage and an outlet passage formed therethrough, and the setting tool further comprises an inlet check valve disposed in the inlet passage and an outlet check valve disposed in the outlet passage.

9. The assembly of claim 5, wherein:

the debris cap has a fill passage formed therethrough closed by a plug, and the debris cap has a relief passage formed therethrough closed by a rupture disk.

10. The assembly of claim 1, wherein the packer actuator further comprises:

a keeper disposed in the housing;

an indicator sleeve disposed in the housing;

a shearable fastener releasably connecting the indicator sleeve to the housing;

a thrust bearing disposed between the keeper and the indicator sleeve; and a radial bearing disposed between the keeper and the housing.

11. The assembly of claim 1, further comprising:

a catcher having a seat for receiving a setting plug;

a passage for being in fluid communication with a lower face of the piston and bypassing the seat.

12. The assembly of claim 11, further comprising:

a running tool connectable to the mandrel and operable to longitudinally and torsionally connect to the tubular string, wherein:

the catcher is connectable to the running tool, and the passage is formed in and along a wall of the running tool and formed in and along a wall of the catcher.

13. The assembly of claim 12, wherein the running tool comprises:

a running mandrel connectable to the mandrel of the setting tool;

a latch for releasably connecting the tubular string to the running mandrel and comprising:

a longitudinal fastener for engaging a longitudinal profile of the tubular string; and a torsional fastener for engaging a torsional profile of the tubular string;

a lock keeping the latch engaged in the locked position;

a piston for releasing the lock and having a lower face in fluid communication with a bore of running mandrel and an upper face in fluid communication with the passage; and a clutch for selectively torsionally connecting the torsional fastener to the body.

14. The assembly of claim 11, wherein the catcher is operable to release the seat and the setting plug from a body thereof and move the seat and the setting plug into a capture chamber.

15. The assembly of claim 11, further comprising:

a damper connectable to the catcher a stinger connectable to the damper;

a release connectable to the stinger;

a spacer connectable to the packoff; and a plug release system connectable to the spacer and comprising:

an equalization valve; and a wiper plug releasably connected to the equalization valve and operable to engage the inner surface of the tubular string.

16. A system, comprising:

the assembly claim 1; and the tubular string comprising:

a polished bore receptacle (PBR) for engagement with the debris cap;

a packer connected to the PBR and having a metallic gland carrying an outer seal and an inner seal and a wedge operable to expand the metallic gland;

a hanger having an upper portion connected to the packer;

a body carrying the hanger and packer and having a latch profile for engagement with the running tool; and a shearable fastener connecting the hanger upper portion to the body.

17. A method of hanging a tubular string in a wellbore, comprising:

running the tubular string into the wellbore using a pipe string and a deployment assembly having:

a debris cap releasably connected to and closing an upper end of the tubular string, a packoff releasably connected to and engaged with the tubular string, and a buffer fluid disposed in a chamber formed between the debris cap and the packoff;

pumping a setting plug through the pipe string to the deployment assembly, thereby operating a piston thereof to set a hanger of the tubular string;

after setting the hanger, lowering the pipe string, thereby setting a packer of the tubular string; and after setting the packer, raising the pipe string, thereby releasing the debris cap and opening the chamber of the buffer fluid.

18. The method of claim 17, wherein:

the deployment assembly further has a mandrel and a seat connected to the mandrel, the piston has an upper face in communication with a port formed through the mandrel above the seat, and the setting plug is pumped to the seat.

19. The method of claim 17, wherein:

the deployment assembly further has a packer actuator disposed above and connected to the debris cap, the debris cap is releasably connected to the mandrel, the piston also releases the debris cap from the mandrel, and the method further comprises, after setting the hanger and before setting the packer, raising the mandrel and the piston, thereby engaging the packer actuator with the piston.

20. The method of claim 17, wherein:

the deployment assembly further comprises a plug release system, and the method further comprises, after setting the hanger and before setting the packer:

pumping cement slurry into the pipe string;

launching a dart into the pipe string;

pumping chaser fluid into the pipe string, thereby driving the dart and cement slurry through the pipe string and deployment assembly and seating the dart into a wiper plug of the plug release system.

* * * * *